US010479638B2

(12) United States Patent
Fujita

(10) Patent No.: US 10,479,638 B2
(45) Date of Patent: Nov. 19, 2019

(54) PRINTING SYSTEM

(71) Applicant: Takehiro Fujita, Kanagawa (JP)

(72) Inventor: Takehiro Fujita, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 71 days.

(21) Appl. No.: 15/516,824

(22) PCT Filed: Oct. 14, 2015

(86) PCT No.: PCT/JP2015/005206

§ 371 (c)(1),
(2) Date: Apr. 4, 2017

(87) PCT Pub. No.: WO2016/059802

PCT Pub. Date: Apr. 21, 2016

(65) Prior Publication Data

US 2017/0247217 A1 Aug. 31, 2017

(30) Foreign Application Priority Data

Oct. 14, 2014 (JP) ..... 2014-210301

(51) Int. Cl.
*B65H 37/04* (2006.01)
*B42C 1/12* (2006.01)
(Continued)

(52) U.S. Cl.
CPC ..... *B65H 37/04* (2013.01); *B41J 2/17566* (2013.01); *B41J 13/0036* (2013.01);
(Continued)

(58) Field of Classification Search
CPC ..... B65H 2301/5161; B65H 2801/24; B42B 5/103; G03G 2215/00848
See application file for complete search history.

(56) References Cited

U.S. PATENT DOCUMENTS 4,523,750 A 6/1985 Hubler
5,954,436 A * 9/1999 Kageyama ..... B41J 3/60 358/1.12

(Continued)

FOREIGN PATENT DOCUMENTS

CN 1754810 A 4/2006
CN 101008800 A 8/2007

(Continued)

OTHER PUBLICATIONS

Extended European Search Report dated Nov. 16, 2017 in Patent Application No. 15850589.1.

(Continued)

*Primary Examiner* — Jennifer E Simmons
(74) *Attorney, Agent, or Firm* — Oblon, McClelland, Maier & Neustadt, L.L.P.

(57) ABSTRACT

A series of conveyance paths to convey a recording medium is formed across a printer and a post-processing device in a printing system. The printing system includes: a detection unit that detects that the post-processing device has entered a predetermined state; and a paper feeding control unit that limits the number of recording media fed to the conveyance path, when it is not detected that the post-processing device has entered the predetermined state, based on the number of recording media conveyable to the post-processing device after the post-processing device enters the predetermined state.

9 Claims, 18 Drawing Sheets

(51) Int. Cl.

| | |
|---|---|
| ***G03G 15/00*** | (2006.01) |
| ***B42B 5/10*** | (2006.01) |
| ***B41J 2/175*** | (2006.01) |
| ***B41J 13/00*** | (2006.01) |
| ***G03G 21/02*** | (2006.01) |
| ***G03G 21/14*** | (2006.01) |

(52) U.S. Cl.

CPC ..... *B42B 5/103* (2013.01); *B42C 1/12* (2013.01); *G03G 15/6508* (2013.01); *G03G 15/6541* (2013.01); *G03G 15/6544* (2013.01); *G03G 15/6582* (2013.01); *G03G 21/02* (2013.01); *G03G 21/14* (2013.01); *B65H 2301/5161* (2013.01); *B65H 2801/24* (2013.01); *G03G 2215/00818* (2013.01); *G03G 2215/00848* (2013.01)

(56) References Cited

U.S. PATENT DOCUMENTS

| | | | |
|---|---|---|---|
| 7,706,736 | B2 | 4/2010 | Watanabe |
| 7,931,262 | B2 | 4/2011 | Ochi et al. |
| 8,074,976 | B2 | 12/2011 | Ochi et al. |
| 8,132,994 | B2 * | 3/2012 | Okada ..... B42B 5/103 412/1 |
| 8,573,582 | B2 | 11/2013 | Miyake et al. |
| 8,672,312 | B2 | 3/2014 | Nonaka |
| 8,727,331 | B2 | 5/2014 | Miyake et al. |
| 9,186,926 | B2 | 11/2015 | Nonaka |
| 2006/0157909 | A1 | 7/2006 | Terao et al. |
| 2010/0091311 | A1 | 4/2010 | Sato et al. |

FOREIGN PATENT DOCUMENTS

| | | | |
|---|---|---|---|
| CN | 101364067 | A | 2/2009 |
| CN | 102295183 | A | 12/2011 |
| EP | 2 208 698 | A1 | 7/2010 |
| JP | 61-84662 | A | 4/1986 |
| JP | 02-086550 | | 3/1990 |
| JP | 02-127360 | | 5/1990 |
| JP | 04-009966 | | 1/1992 |
| JP | 04-366856 | | 12/1992 |
| JP | 2003-292229 | A | 10/2003 |
| JP | 2004-325825 | | 11/2004 |
| JP | 4872808 | | 12/2011 |
| JP | 2012-048163 | | 3/2012 |
| JP | 5183263 | | 1/2013 |
| JP | 2014-137512 | | 7/2014 |

OTHER PUBLICATIONS

International Search Report and Written Opinion dated Jan. 12, 2016 in PCT/JP2015/005206 filed Oct. 14, 2015.

Office Action dated Sep. 4, 2018 in Japanese Patent Application No. 2014-210301, 3 pages.

* cited by examiner

[Fig. 1]
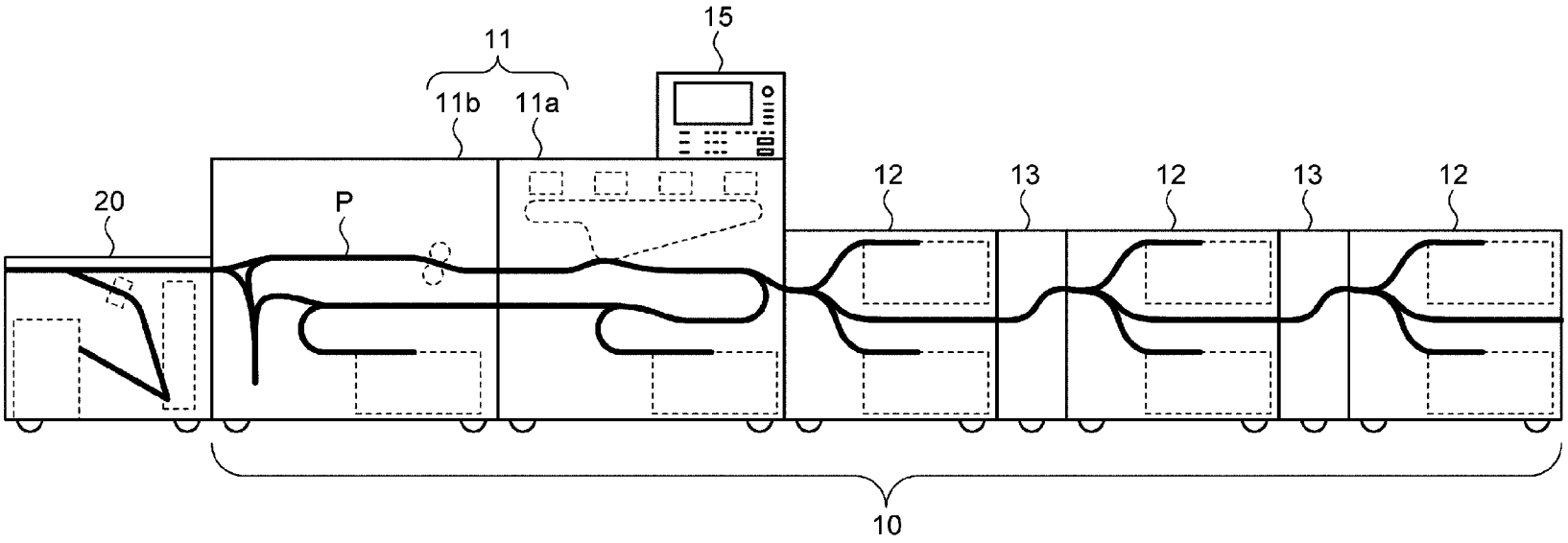

[Fig. 2]
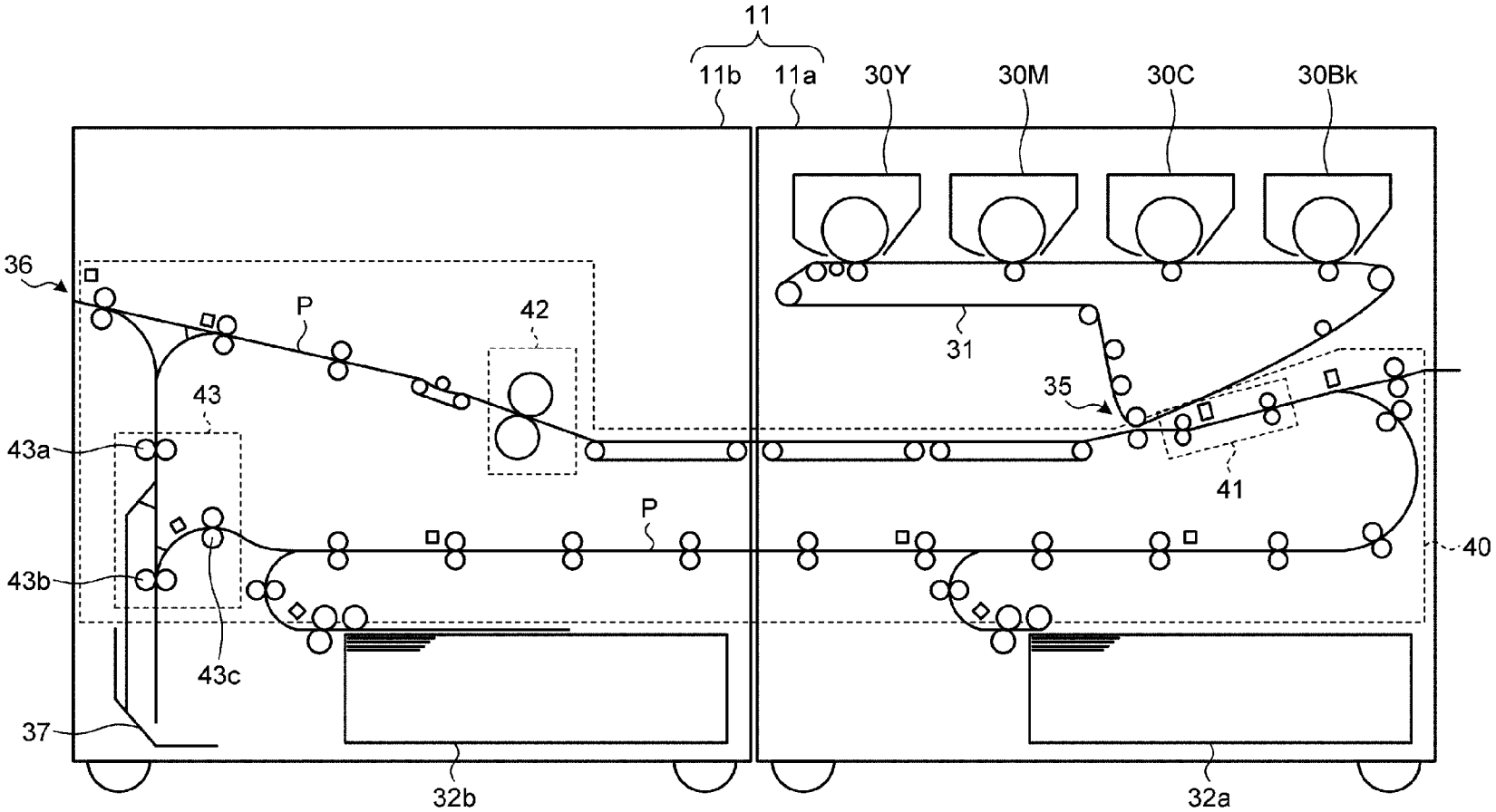

[Fig. 3]
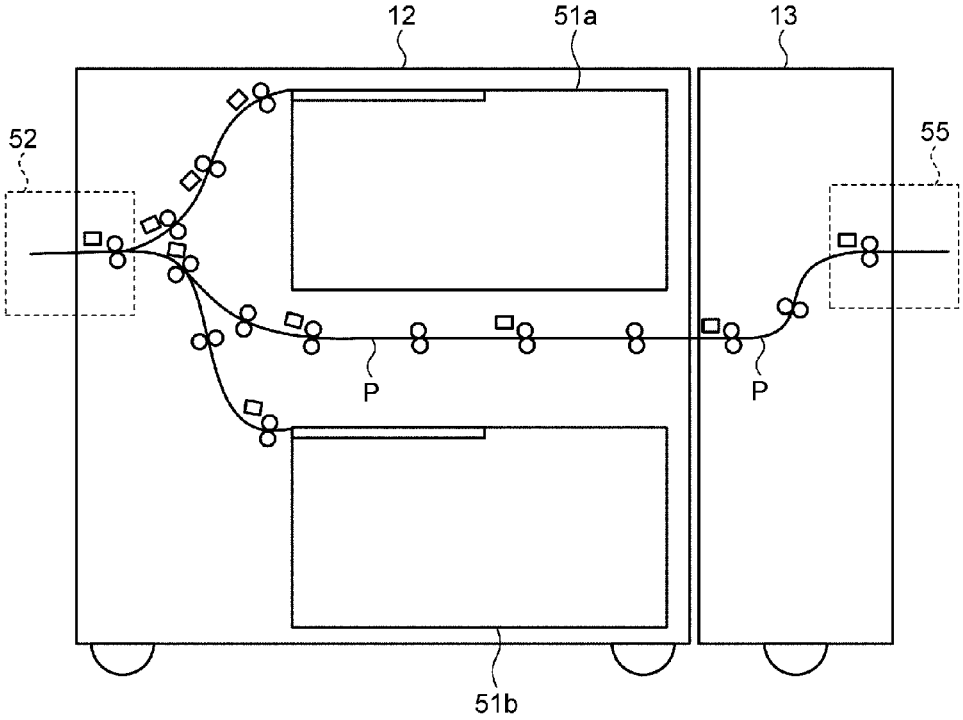
[Fig. 4]
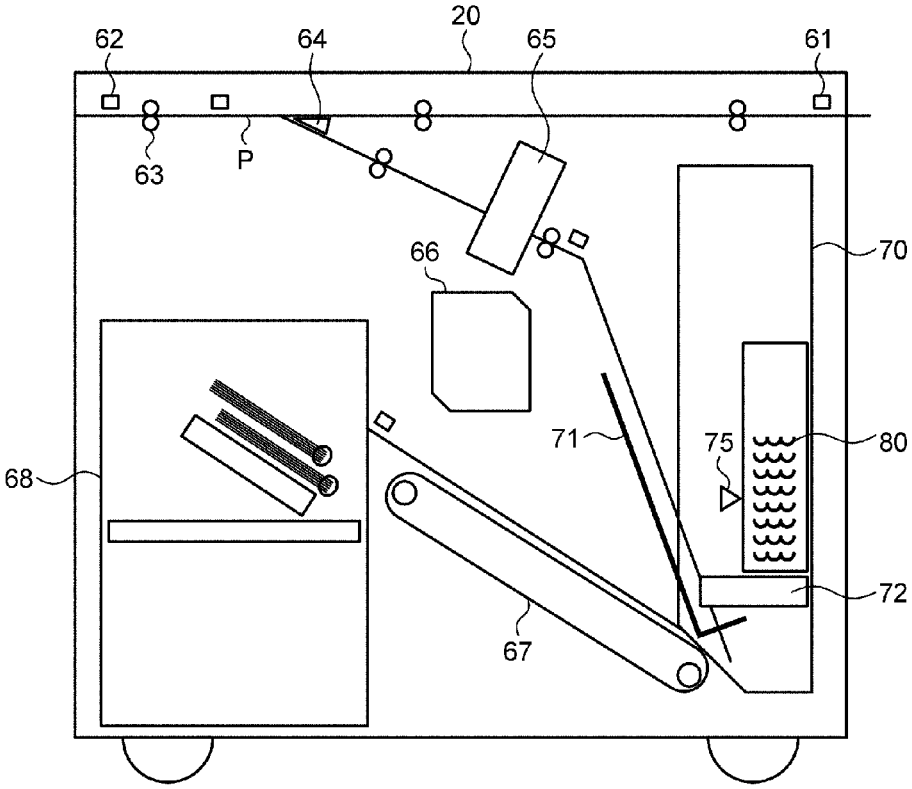

[Fig. 5]
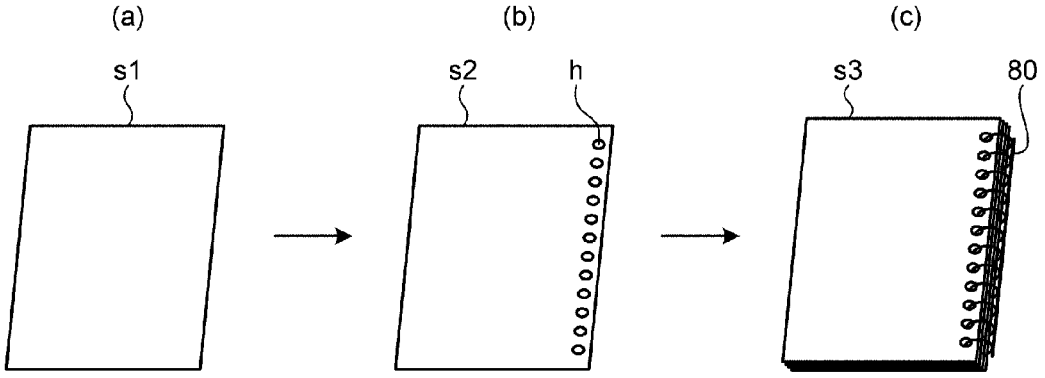

[Fig. 6]
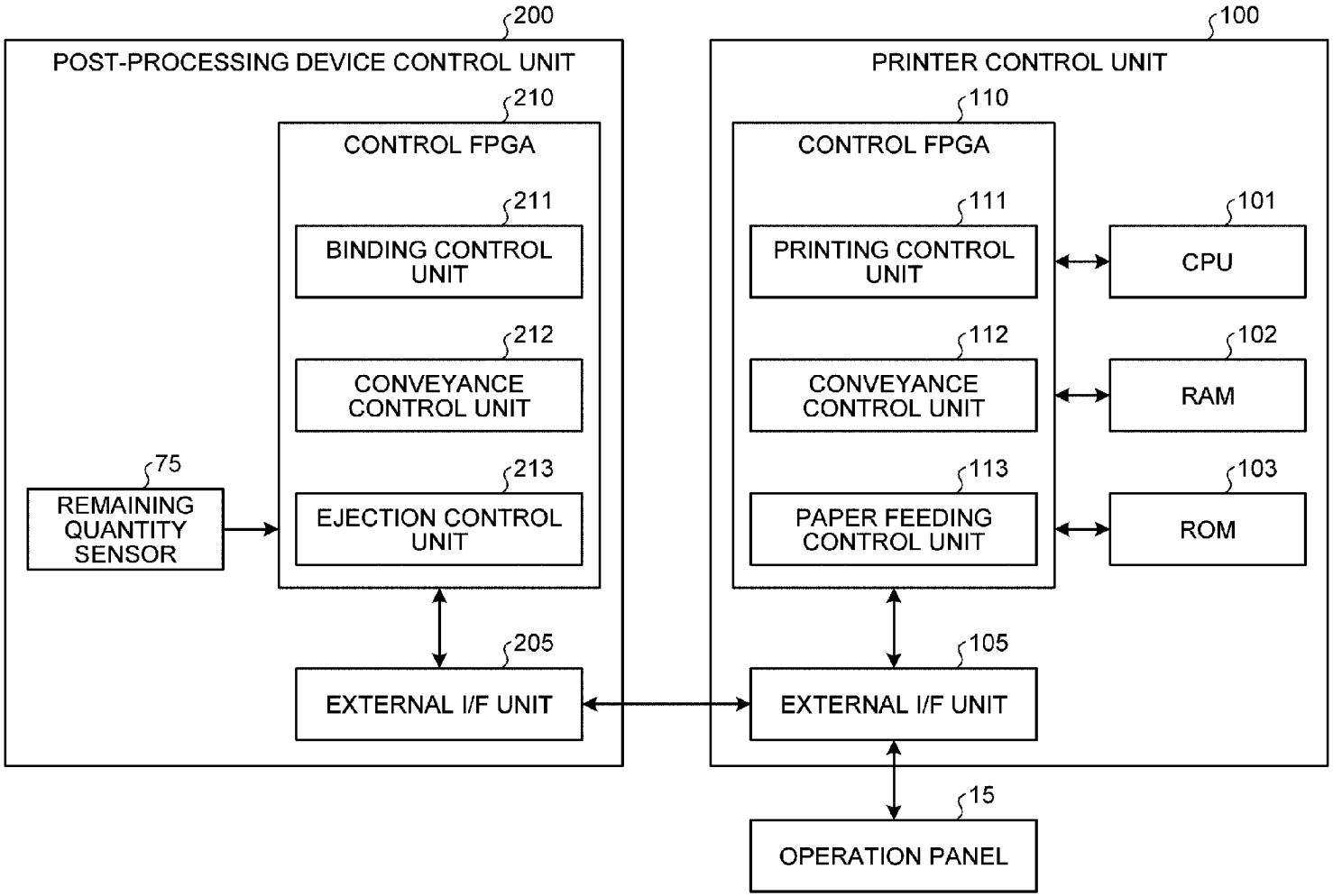

[Fig. 7]
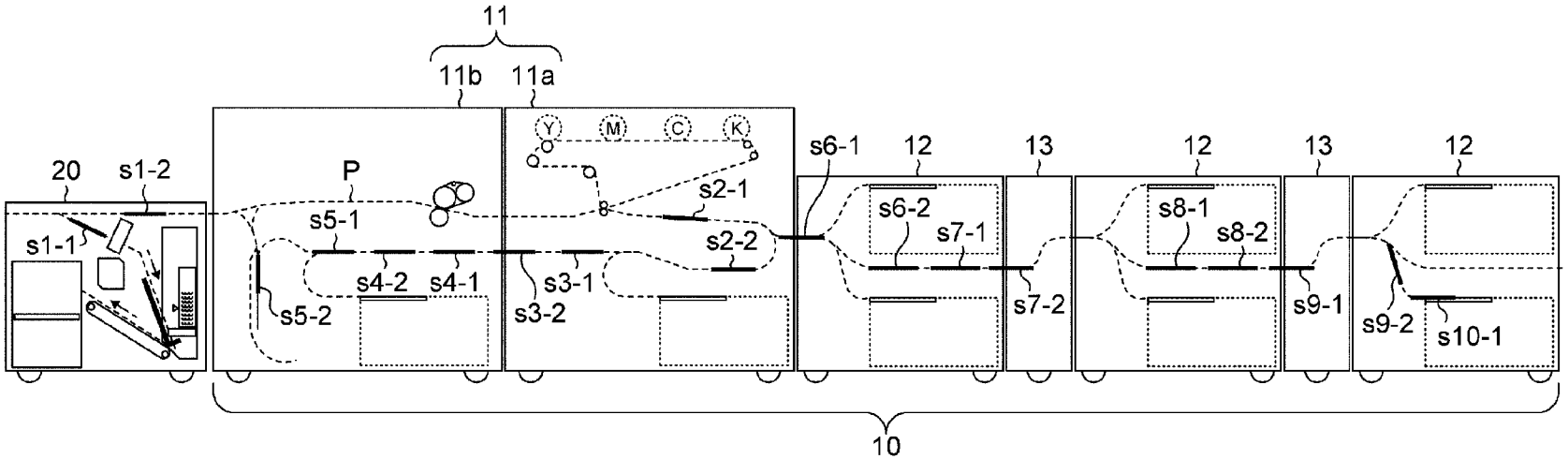

[Fig. 8]
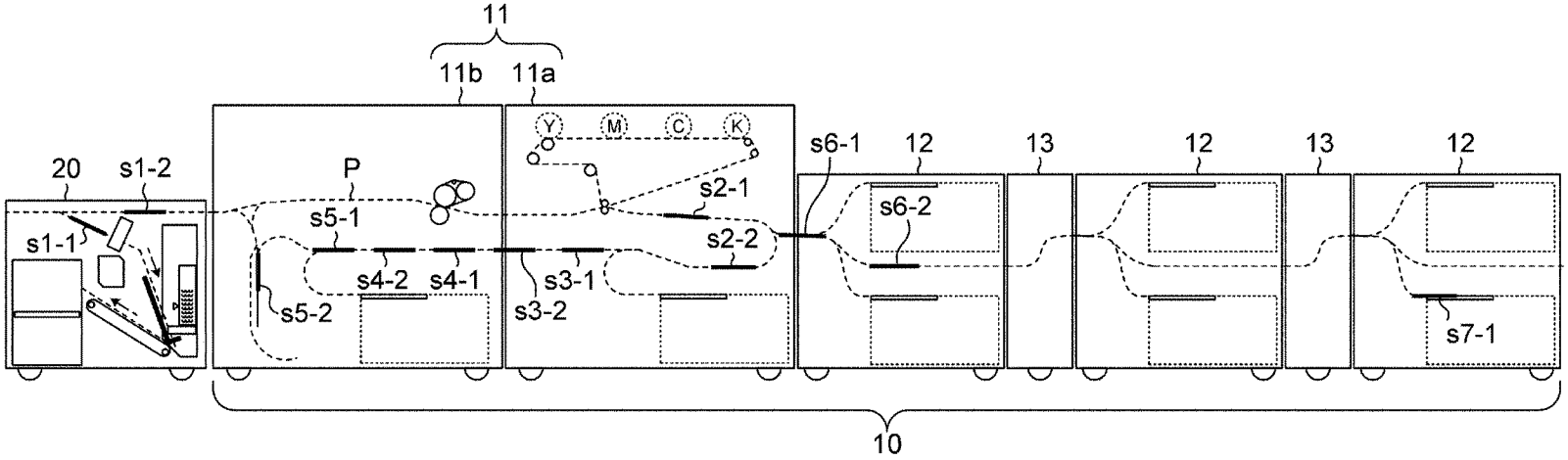

[Fig. 9]
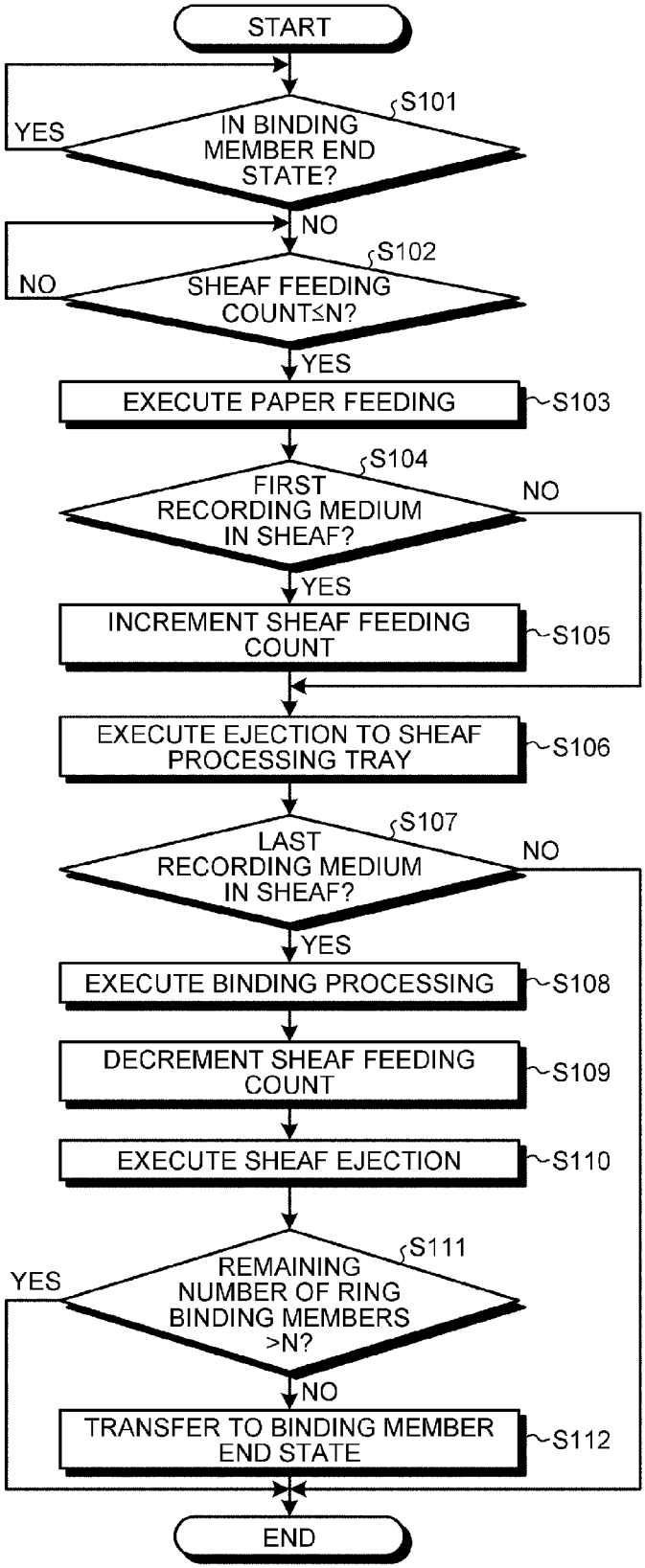

[Fig. 10]
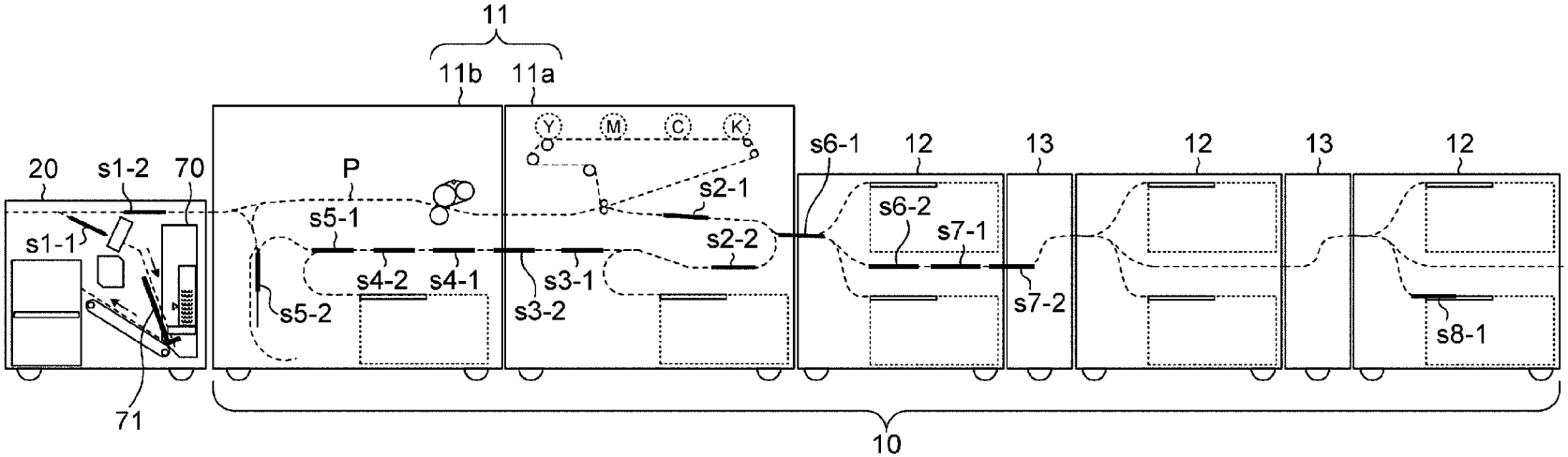

[Fig. 11]
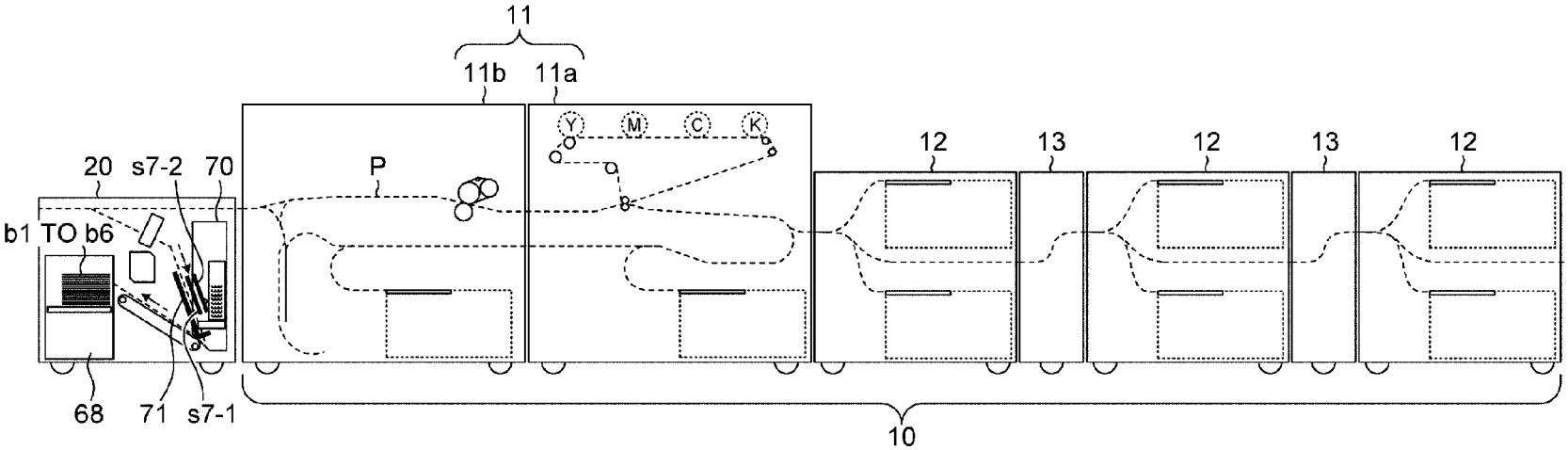

[Fig. 12]
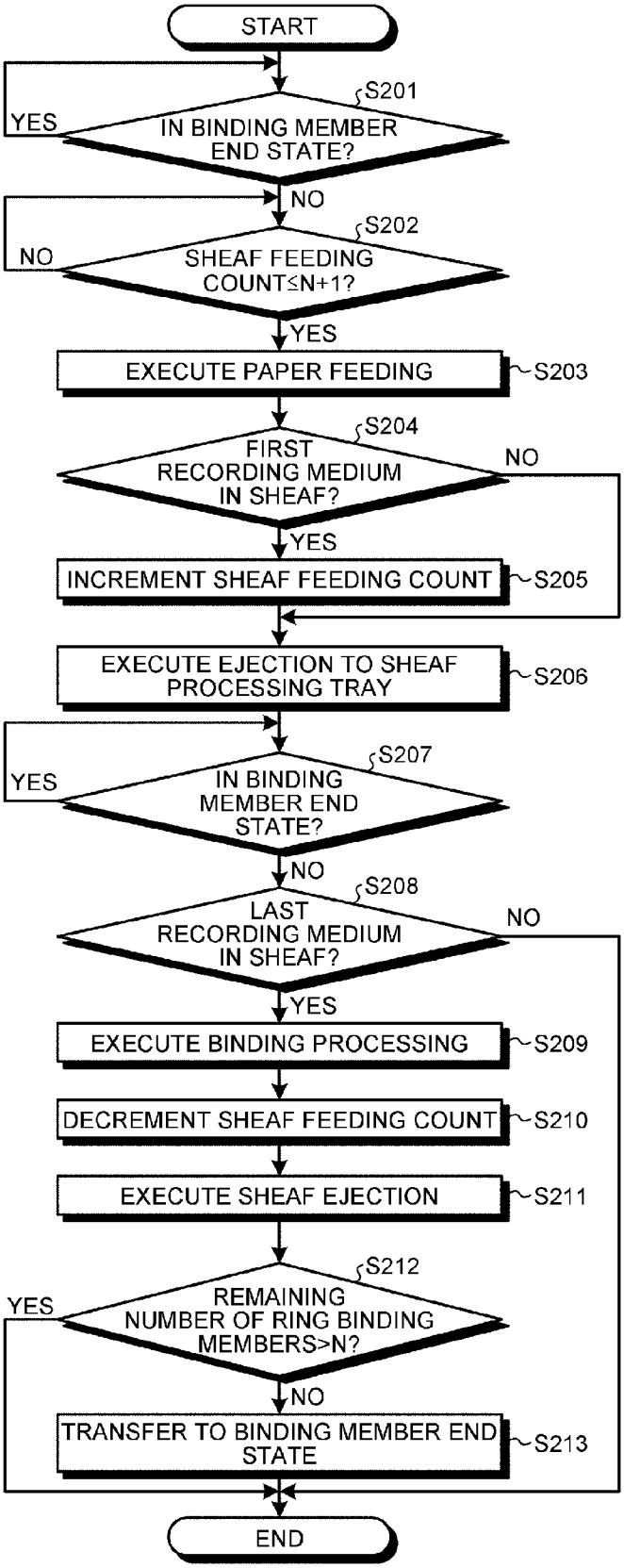

[Fig. 13]
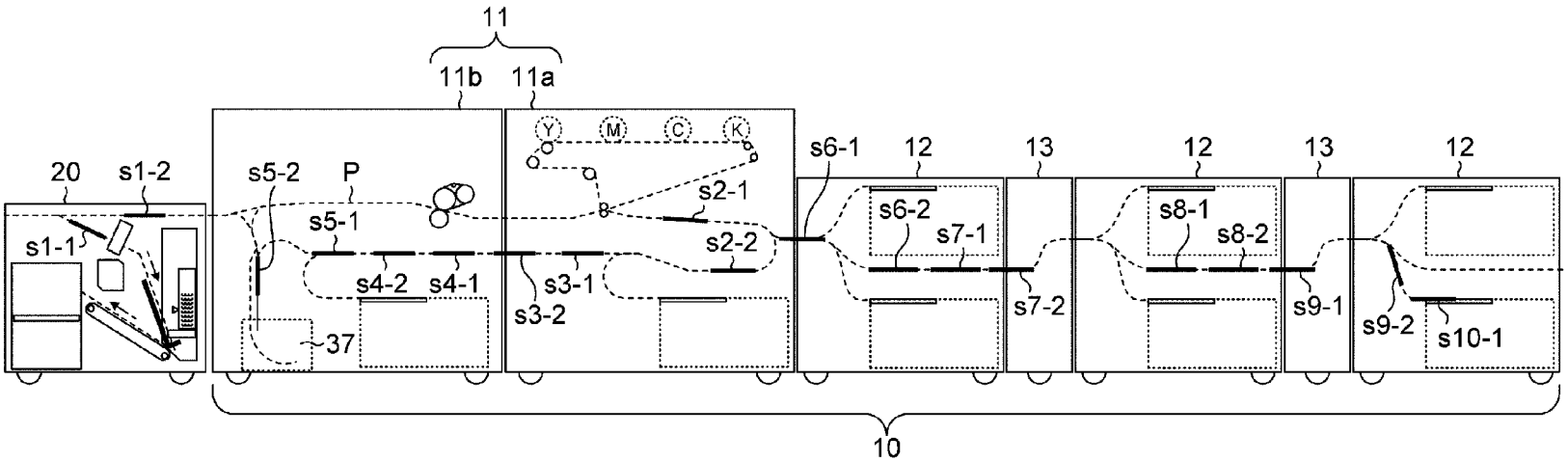

[Fig. 14]
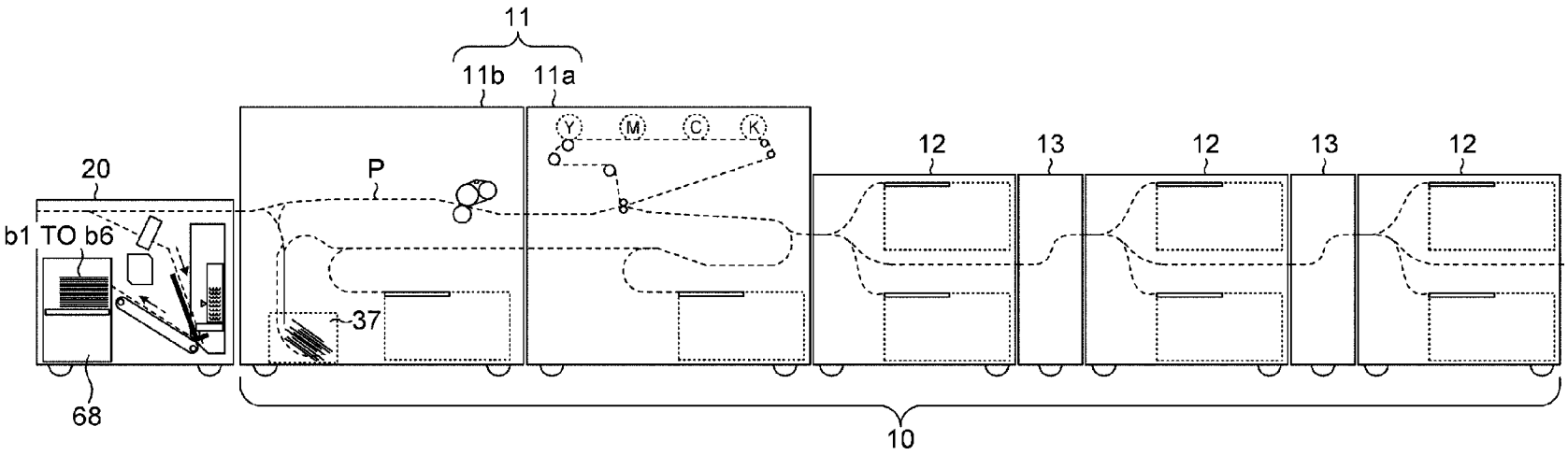

[Fig. 15]
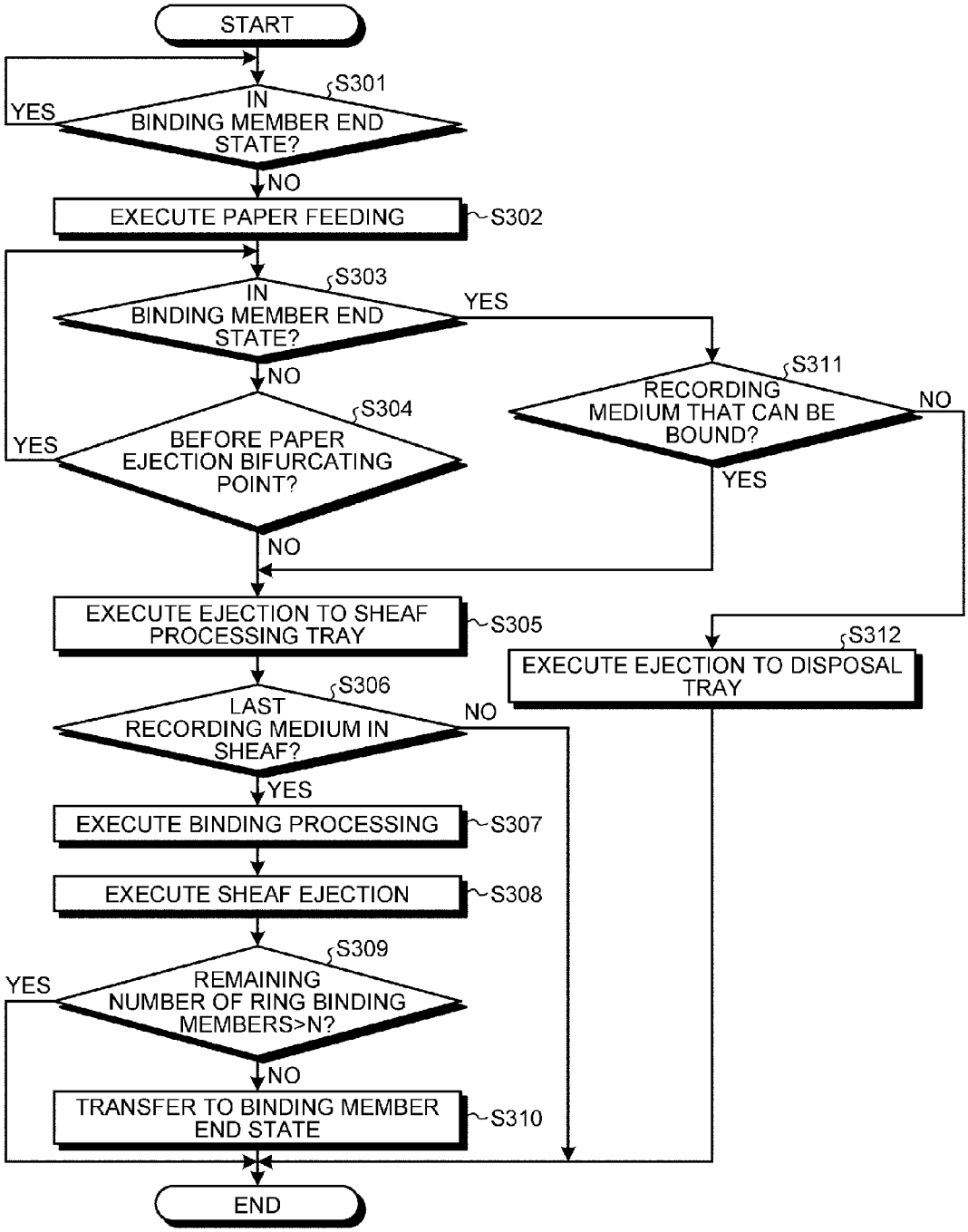

[Fig. 16]
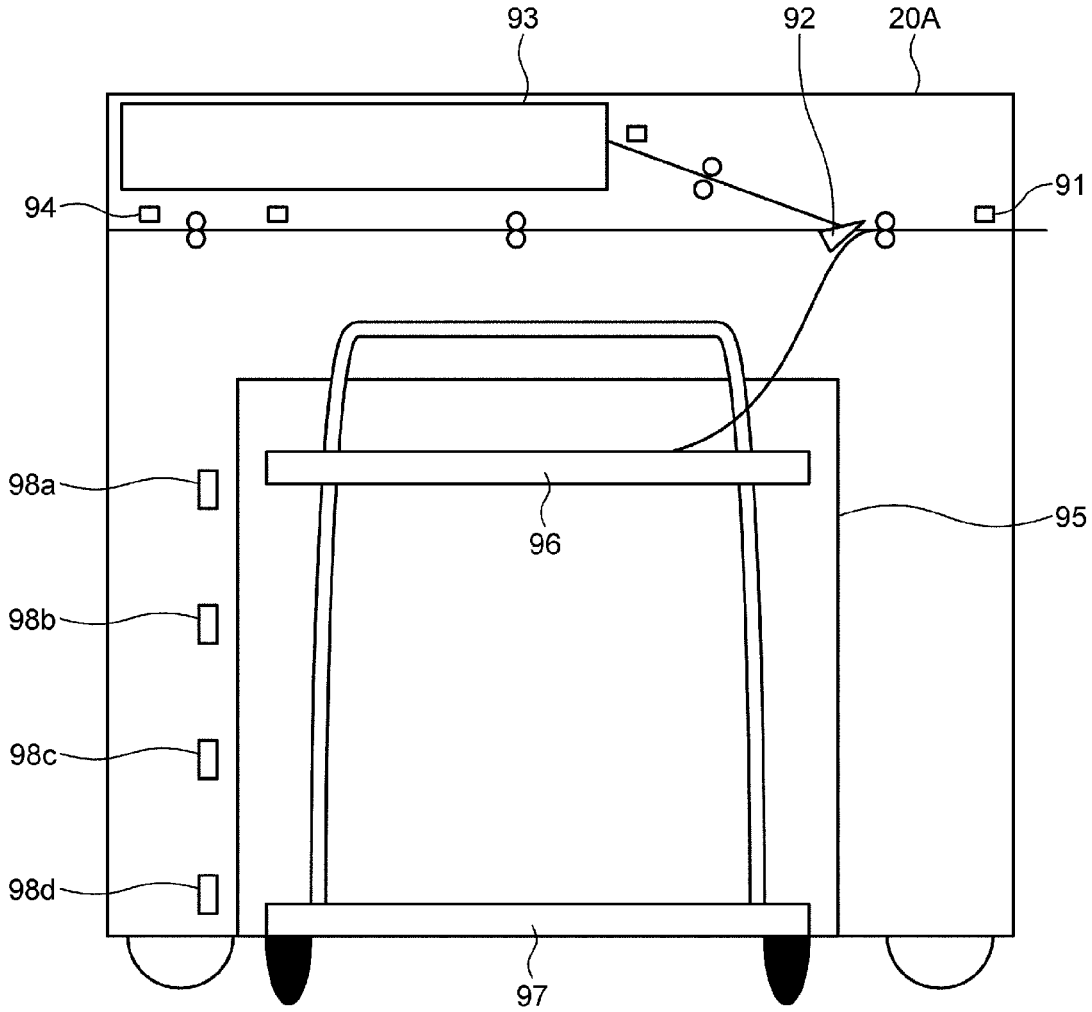

[Fig. 17]
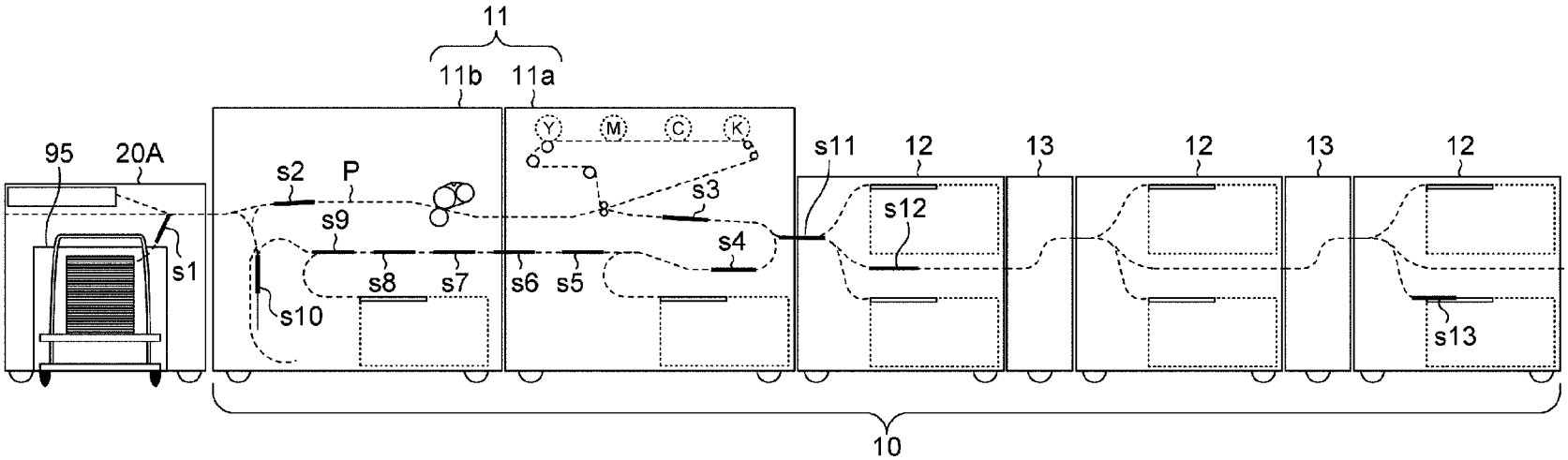

[Fig. 18]
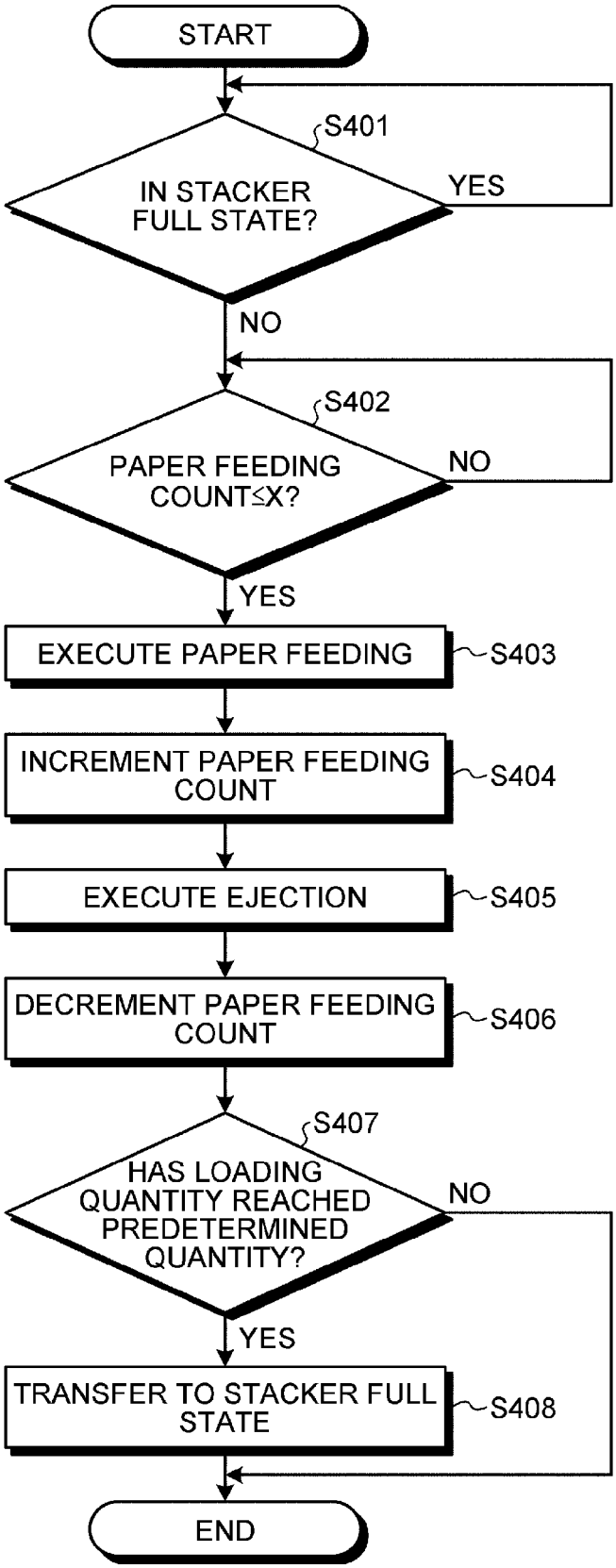

[Fig. 19]
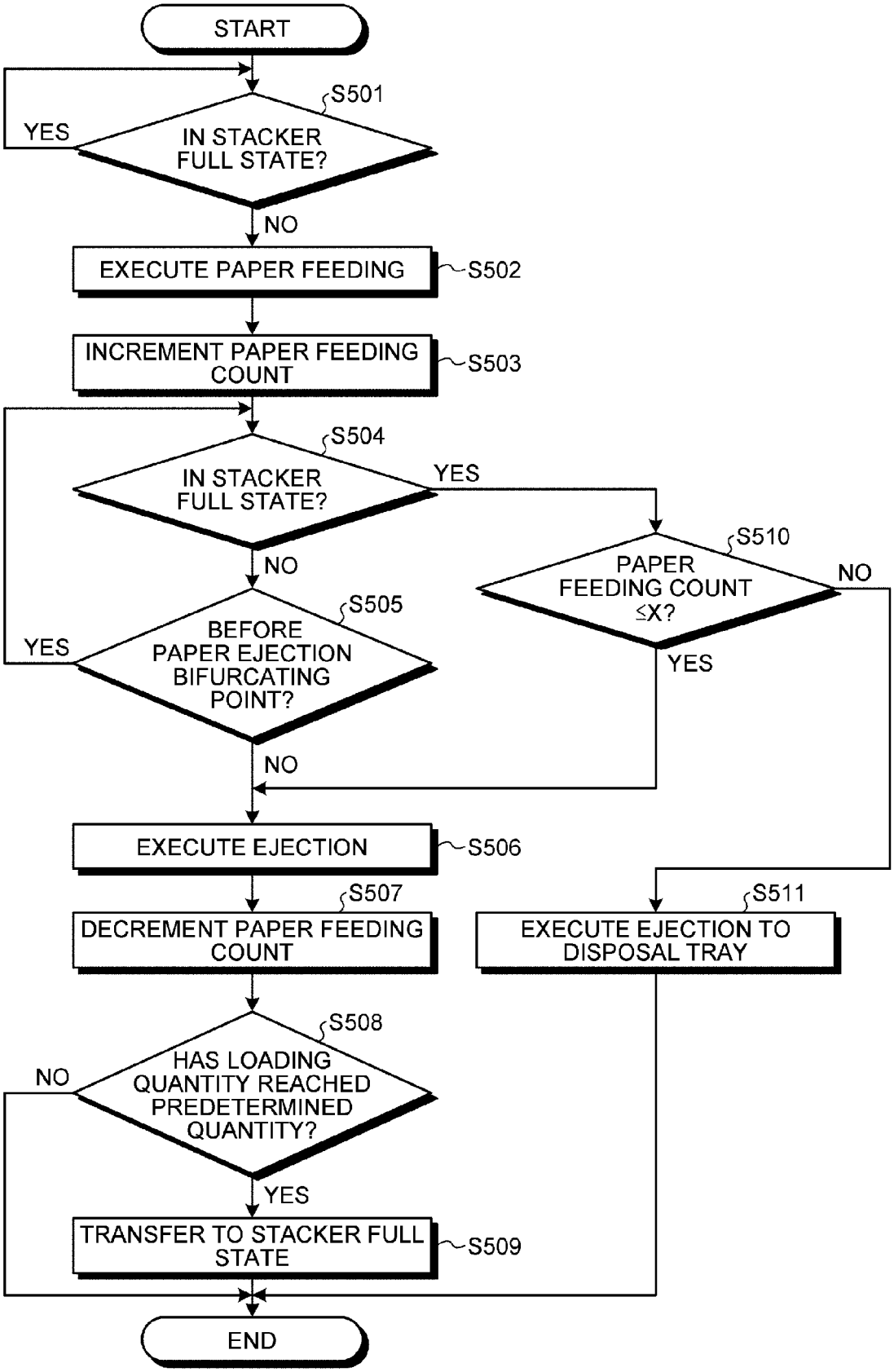

PRINTING SYSTEM

TECHNICAL FIELD

The present invention relates to a printing system.

BACKGROUND ART

Conventionally, a printing system is known where a post-processing device is connected in downstream of a printer such that printing to post-processing can be performed in a batch. For example, in a printing system where a ring binder is used as a post-processing device, printing by a printer and ring binding processing, where printed recording media are bound with a ring binding member for every number of recording media designated by a job, can be performed in an in-line manner, thereby achieving high productivity.

In the printing system of this kind, when it is detected that the post-processing device has entered a predetermined state, such as when a remaining number of the ring binding members used for ring binding has become a predetermined number, the printer is notified of a deactivate request, whereupon printing is halted. This allows for avoiding a disadvantage of paper jam (jammed or retained recording media in a conveyance path) occurrence due to conveyance of a recording medium even when the post-processing device is not capable of performing post-processing such as when no ring binding member is remaining.

Note that Patent Literature 1 discloses a technique where, in a post-processing device performing staple processing, when scrap staples in a staple unit become full, interference time is calculated where the staple unit interferes with a conveyance path when moving to a disposal position of the scrap staples. By requesting for stopping supply of recording media for a time period corresponding to the calculated interference time, collision of the recording media against the moving staple unit can be avoided.

SUMMARY OF INVENTION

Technical Problem

Meanwhile, in the aforementioned printing system, serially connecting an external paper feeding unit to a main unit of the printer can increase the total number of recording media that can be accommodated or kinds of compatible recording media. In this case, however, since the length of a series of conveyance paths formed across the printer and the post-processing device becomes long, the aforementioned paper jam occurrence may not be avoided only by halting printing when it is detected that the post-processing device has entered a predetermined state as in the conventional art.

Solution to Problem

A series of conveyance paths to convey a recording medium is formed across a printer and a post-processing device in a printing system. The printing system includes: a detection unit that detects that the post-processing device has entered a predetermined state; and a paper feeding control unit that limits the number of recording media fed to the conveyance path, when it is not detected that the post-processing device has entered the predetermined state, based on the number of recording media conveyable to the post-processing device after the post-processing device enters the predetermined state.

Advantageous Effects of Invention

According to the present invention, even when the length of conveyance paths for conveying a recording medium becomes long, paper jam occurrence due to conveyance of excessive recording media can be effectively avoided.

BRIEF DESCRIPTION OF DRAWINGS

FIG. 1 is a schematic configuration diagram illustrating an overall configuration of a printing system of an embodiment.

FIG. 2 is a diagram illustrating an exemplary configuration of a main unit of a printer.

FIG. 3 is a diagram illustrating an exemplary configuration of a paper feeding unit and a relay unit.

FIG. 4 is a diagram illustrating an exemplary configuration of a post-processing device (ring binder).

FIG. 5 is a diagram describing processing performed on recording media by the post-processing device.

FIG. 6 is a block diagram illustrating an exemplary configuration of a control system in the printing system of the embodiment.

FIG. 7 is a diagram illustrating a specific example of paper feeding control of the conventional art.

FIG. 8 is a diagram illustrating a specific example of paper feeding control of a first embodiment.

FIG. 9 is a flowchart describing a processing procedure of paper feeding control of the first embodiment.

FIG. 10 is a diagram illustrating a specific example of paper feeding control of a second embodiment.

FIG. 11 is a diagram illustrating the specific example of paper feeding control of the second embodiment.

FIG. 12 is a flowchart describing a processing procedure of paper feeding control of the second embodiment.

FIG. 13 is a diagram illustrating a specific example of operations of a third embodiment.

FIG. 14 is a diagram illustrating the specific example of operations of the third embodiment.

FIG. 15 is a flowchart describing a processing procedure of paper feeding control of the third embodiment.

FIG. 16 is a diagram illustrating an exemplary configuration of a post-processing device (stacker).

FIG. 17 is a diagram illustrating a specific example of paper feeding control of a fourth embodiment.

FIG. 18 is a flowchart describing a processing procedure of paper feeding control of the fourth embodiment.

FIG. 19 is a flowchart describing a processing procedure of paper feeding control of the fourth embodiment.

DESCRIPTION OF EMBODIMENTS

A printing system of an embodiment will be described in detail below with reference to the accompanying drawings.

First Embodiment

FIG. 1 is a schematic configuration diagram illustrating an overall configuration of a printing system of the present embodiment. The printing system includes a post-processing device 20 connected in downstream of a printer 10 such that printing to post-processing are performed in a batch (in an in-line manner). Therefore, in the printing system, a series of conveyance paths P (paths illustrated in bold lines in the drawing) for conveying a recording medium is formed across the printer 10 and the post-processing device 20. Note that the descriptions of "upstream" and "downstream" in the present description denote upstream and downstream, respectively, of a conveyance direction of a recording medium.

In the embodiment, the printer 10 is exemplified by a printer of the electrophotography type, especially a tandem type color printer of the intermediate transfer type; however, a configuration of the printer 10 is not limited thereto. For example, a printer of another type such as an inkjet printer that performs printing by ejecting inks onto a recording medium may be used as the printer 10.

Also, the post-processing device 20 is exemplified by a ring binder in the embodiment; however, a configuration of the post-processing device 20 is not limited thereto. The post-processing device 20 of the embodiment is only required to perform processing where recording media printed by the printer 10 are bound for every number of recording media designated by a job with a consumable binding member (sheaf processing), thereby generating a sheaf of recording media. Therefore, for example, a stapler or a saddle stitching binder may be used instead of the ring binder. The stapler is a post-processing device that performs staple processing where a plurality of recording media is bound with a staple needle (binding member). The saddle stitching binder is a post-processing device that performs saddle stitching binding processing where a plurality of recording media is aligned, folded in the middle, and bound at the folded position with a plurality of staple needles (binding members). Alternatively, as the post-processing device 20, an example of using a stacker for loading printed recording media in an alignment in a medium loading unit is also assumed. However, this example will be described later as another embodiment.

As illustrated in FIG. 1, the printer 10 includes a plurality of paper feeding units 12 (three paper feeding units 12 in the example of FIG. 1) externally connected in upstream of a main unit 11 that executes a printing process. The multiple paper feeding units 12 are serially connected with each other in upstream of the main unit 11, with a relay unit 13 interposed between the neighboring paper feeding units 12. The number of the paper feeding units 12 externally connected to the main unit 11 may be arbitrarily changed within a range supported by the main unit 11. The length of the conveyance paths P in the printing system changes according to the number of the paper feeding units 12. The larger the number of the paper feeding units 12, the longer the length of the conveyance paths P.

As illustrated in FIG. 1, the main unit 11 of the printer 10 is separated into two units 11*a* and 11*b*, each having an independent housing. The main unit 11 includes these two units 11*a* and 11*b* serially connected with each other. It should be understood that such a configuration of units is a mere example and thus the main unit 11 may include one body having one housing. An operation panel 15 is connected to the main unit 11 of the printer 10. The operation panel 15 is a user interface for displaying various information to an operator (user) and accepting various input operations by the operator.

FIG. 2 is a diagram illustrating an exemplary configuration of the main unit 11 of the printer 10. As illustrated in FIG. 2, image formation units 30Y, 30M, 30C, and 30Bk are arranged along an intermediate transfer belt 31, which is an intermediate transfer body, in the main unit 11. These image formation units 30Y, 30M, 30C, and 30Bk form toner images in yellow, magenta, cyan, and black, respectively, in an electrophotography process. Sequential transfer (primary transfer) of these toner images in the respective colors to the intermediate transfer belt 31 forms a toner image in full color on the intermediate transfer belt 31. Note that, since the technique to form the toner image in the electrophotography process is known, a detailed description is omitted here.

The main unit 11 further includes two paper feeding trays 32*a* and 32*b* and a conveyance unit 40. The conveyance unit 40 integrates mechanical units including a mechanism for conveying a recording medium along a conveyance path P in the main unit 11 (conveyance roller or conveyance belt), sensors discretely disposed along the conveyance path P (sensors for detecting passage of the recording medium), a skew correcting unit 41, a fixing unit 42, and a reversing unit 43.

In the printing system of the embodiment, a recording medium is taken out one by one from one of the paper feeding trays 32 and 32*b* in the main unit 11 and paper feeding trays in the paper feeding units 12 and conveyed along the conveyance path P. This recording medium is subjected to skew correction or lateral location correction in the skew correcting unit 41 and then conveyed to a secondary transfer position 35 in time for the timing when the toner image on the intermediate transfer belt 31 reaches the secondary transfer position 35. Thereafter, the recording medium to which the toner image on the intermediate transfer belt 31 has been transferred (secondary transfer) at the secondary transfer position 35 is conveyed to the fixing unit 42 and subjected to a process where the toner image is fixed to the recording medium by heating and pressing in the fixing unit 42, thereby printing an image on the recording medium.

Here, in the case of single-sided printing, the recording medium to which the toner image has been fixed by the fixing unit 42 is ejected from the main unit 11 of the printer 10 to the subsequent post-processing device 20. When face-up paper ejection is performed where a paper is ejected with a printed surface facing up, the recording medium to which the toner image has been fixed by the fixing unit 42 is conveyed to an ejection unit 36 as it is and ejected from the ejection unit 36 to the post-processing device 20. On the other hand, when face-down paper ejection is performed where a paper is ejected with a printed surface facing down, the recording medium to which the toner image has been fixed by the fixing unit 42 is conveyed to the reversing unit 43. Thereafter, a switch-back operation of the recording medium is performed by forward rotation, halt, and reverse rotation of a reversing paper ejection roller 43*a* including a pressure and separation mechanism, whereby the recording medium is ejected from the ejection unit 36 to the post-processing device 20 with the printed surface facing down. Note that in the case of face-down paper ejection, the subsequent recording medium gains speed and passes through during the switch-back operation. The reversing paper ejection roller 43*a* includes the pressure and separation mechanism and thus provides separation after a tip of the preceding recording medium passes a roller of the ejection unit 36, then accepts a recording medium incoming to the reversing paper ejection roller 43*a*, and then again presses against the recording medium for the switch-back operation thereof, thereby allowing for sequentially performing face-down paper ejection.

Furthermore, in the case of double-sided printing, the recording medium to which the toner image has been fixed by the fixing unit 42 is conveyed to the reversing unit 43 and subjected to the switch-back operation by forward rotation, halt, and reverse rotation of a double-sided rotation roller 43*b*. The recording medium, conveyance timing of which is coordinated by a double-sided conveyance roller 43*c* such that the recording medium does not interfere with another recording medium, is then conveyed along the conveyance path P with the printed surface facing down and reaches the skew correcting unit 41. Thereafter, printing is performed on the back surface of the recording medium in a similar process to the single-sided printing and the recording medium to which a toner image has been fixed on the back surface thereof by the fixing unit 42 is ejected from the ejection unit 36 to the post-processing device 20. Note that a disposal tray 37 is provided near the reversing unit 43 and an unwanted recording medium in the conveyance path P can be ejected to the disposal tray 37 via the reversing unit 43 as a disabled paper.

FIG. 3 is a diagram illustrating an exemplary configuration of a paper feeding unit 12 and a relay unit 13 connected in upstream of the main unit 11. As illustrated in FIG. 3, the paper feeding unit 12 includes two paper feeding trays 51*a* and 51*b* and an ejection unit 52. The ejection unit 52 is configured to be connectable to the main unit 11 of the printer 10. Connecting the paper ejection unit 52 to the main unit 11 of the printer 10 allows for connecting a conveyance path P in the paper feeding unit 12 to the conveyance path P in the conveyance unit 40 of the main unit 11. When a recording medium is taken out from one of the paper feeding trays 51*a* and 51*b* of the paper feeding unit 12, this recording medium is conveyed into the conveyance unit 40 of the main unit 11 via the ejection unit 52.

The paper feeding unit 12 is also configured to be serially connectable to another paper feeding unit 12 via the relay unit 13. The relay unit 13 includes an introducing unit 55 and this introducing unit 55 of the relay unit 13 is connected to the ejection unit 52 of the upstream paper feeding unit 12. As a result, the conveyance path P in the paper feeding unit 12 is connected to a conveyance path P in the other paper feeding unit 12 via a conveyance path P in the relay unit 13.

The printing system of the embodiment may include the plurality of external paper feeding units 12 serially connected to the main unit 11 of the printer 10. Therefore, the larger the number of the paper feeding units 12 connected to the main unit 11 of the printer 10, the longer the length of the conveyance paths P of the entire printing system including the post-processing device 20.

FIG. 4 is a diagram illustrating an exemplary configuration of the post-processing device 20. The post-processing device 20 of the embodiment is configured as the ring binder, which binds the recording media printed by the printer 10 with a ring binding member for every number of recording media designated by a job, whereby a sheaf of recording media is generated (bound) and ejected.

The printed recording media ejected from the printer 10 are detected by an inlet sensor 61 and then conveyed along a conveyance path P in the post-processing device 20 toward an outlet sensor 62. Here, when the sheaf processing is not performed on the printed recording media, the recording medium conveyed toward the outlet sensor 62 is ejected to the outside of the post-processing device 20 as it is.

On the other hand, when the sheaf processing is performed on the printed recording media, the switch-back operation is performed by reverse rotation of an outlet roller 63 and switching of a bifurcating claw 64 upon detection of the recording medium by the outlet sensor 62, thereby conveying the recording medium to a punching processing unit 65. The punching processing unit 65 forms a plurality of punched holes in the conveyed recording medium for passing a ring binding member 80 therethrough. The recording medium in which punched holes are formed by the punching processing unit 65 is conveyed to a sheaf processing unit 70. Note that punching chips generated by processing in the punching processing unit 65 are accumulated in a chip accumulation unit 66.

The recording medium conveyed to the sheaf processing unit 70 stands by at the sheaf processing tray 71 until the recording media of the designated number, namely, all the recording media to be included in a sheaf, are collected. Once all the recording media to be included in the sheaf are collected in the sheaf processing tray 71, the binding processing unit 72 performs processing. The binding processing unit 72 binds the recording media collected in the sheaf processing tray 71 with the ring binding member 80, thereby generating (binding) the sheaf of recording media. The sheaf of recording media bound by the binding processing unit 72 is ejected to a sheaf ejecting tray 68 by a conveyance belt 67.

The sheaf processing unit 70 includes a remaining quantity sensor 75 (an example of a detection unit) which detects that the remaining number of the ring binding members 80 equals N (where N is a predetermined number such as 5). The remaining quantity sensor 75 operates at a timing, for example, when the sheaf of recording media bound by the binding processing unit 72 is ejected to the sheaf ejecting tray 68 and, if the remaining number of the ring binding members 80 equals N at this timing, detects as such. The state where the remaining quantity sensor 75 detects that the remaining number of the ring binding members 80 has become N is hereinafter referred to as a "binding member end state". When the post-processing device 20 enters the binding member end state, the post-processing device 20 notifies the printer 10 of a deactivate request of printing, whereupon printing is halted. When printing is halted, no new recording medium is fed and thus only recording media which have been already fed are conveyed to the post-processing device 20. In the post-processing device 20, these recording media having been fed are subjected to processing by the binding processing unit 72 with the remaining ring binding member 80.

FIG. 5 is a diagram describing processing performed on recording media by the post-processing device 20. A plurality of punched holes h is formed in a recording medium s1 (refer to FIG. 5(*a*)), conveyed to the post-processing device 20 from the printer 10, in the punching processing unit 65, thereby generating a punched recording medium s2 (refer to FIG. 5(*b*)). The punched recording medium s2 stands by at the sheaf processing tray 71 of the sheaf processing unit 70 until the recording media of the number designated by the job (the number of recording media to be included in a sheaf) are collected. When the punched recording media s2 of the designated number are collected, processing to bind these recording media by the binding processing unit 72 with the ring binding member 80 is performed and a sheaf s3 (refer to FIG. 5(*c*)) of recording media is generated and ejected to the sheaf ejecting tray 68. Here, when the remaining number of the ring binding members 80 equals N, the remaining quantity sensor 75 detects as such. In this case, the post-processing device 20 enters the binding member end state, whereupon printing by the printer 10 is halted.

FIG. 6 is a block diagram illustrating an exemplary configuration of a control system in the printing system of the embodiment, especially explicitly illustrating parts related to control characteristic to the embodiment. A control system in the printing system of the embodiment includes a printer control unit 100 and a post-processing device control unit 200 as illustrated in FIG. 6.

The printer control unit 100 includes a CPU 101, a RAM 102, a ROM 103, a control field-programmable gate array (FPGA) 110, and an external interface (I/F) unit 105 as illustrated in FIG. 6.

The CPU 101 controls the entire printer 10. For example, the CPU 101 executes various control programs stored in the ROM 103 while using the RAM 102 as a work area, thereby generating and outputting control commands for controlling various operations in the printer 10. Here, the CPU 101 refers to various information designated by the job, user operations accepted by the operation panel 15, a signal from sensors disposed along the conveyance path P in the printer 10, etc.

The control FPGA 110 controls various operations in the printer 10 in collaboration with the CPU 101. The control FPGA 110 includes, for example, a printing control unit 111, a conveyance control unit 112, and a paper feeding control unit 113 as functional components.

The printing control unit 111 controls operations of the image formation units 30Y, 30M, 30C, and 30Bk and the fixing unit 42, thereby controlling the printing process in the printer 10.

The conveyance control unit 112 controls operations of the conveyance roller, the conveyance belt, the bifurcating claw, the skew correcting unit 41, and the reversing unit 43 disposed along the conveyance path P in the printer 10, thereby controlling conveyance of the recording medium in the conveyance path P in the printer 10.

The paper feeding control unit 113 controls paper feeding of the recording medium to the conveyance path P from the paper feeding trays 32*a* and 32*b* in the main unit 11 of the printer 10 or from the paper feeding trays 51*a* and 51*b* in the paper feeding unit 12 connected to the main unit 11. Especially, this paper feeding control unit 113 limits the number of recording media fed to the conveyance path P based on the number of recording media that can be conveyed to the post-processing device 20 after the post-processing device 20 enters the binding member end state, when the remaining quantity sensor 75 of the post-processing device 20 does not detect that the remaining number of the ring binding members 80 has become N, namely, when the post-processing device 20 has not entered the binding member end state. Note that details of a specific example of paper feeding control of the embodiment will be described later.

The external I/F unit 105 allows the printer control unit 100 to communicate with the post-processing device control unit 200, the operation panel 15, or the like.

The post-processing device control unit 200 includes the remaining quantity sensor 75, a control FPGA 210, and an external interface (I/F) unit 205 as illustrated in FIG. 6. As described above, the remaining quantity sensor 75 detects when the remaining number of the ring binding members 80 equals N.

The control FPGA 210 controls various operations in the post-processing device 20. The control FPGA 210 includes, for example, a binding control unit 211, a conveyance control unit 212, and an ejection control unit 213 as functional components.

The binding control unit 211 controls operations of the punching processing unit 65 and the sheaf processing unit 70, thereby controlling ring binding processing in the post-processing device 20.

The conveyance control unit 212 controls operations of the outlet roller 63, the bifurcating claw 64, or the like based on a signal from the inlet sensor 61 or the outlet sensor 62 disposed along the conveyance path P in the post-processing device 20, thereby controlling conveyance of the recording medium in the conveyance path P in the post-processing device 20.

The ejection control unit 213 causes the conveyance belt 67 to operate in conjunction with operations of the binding processing unit 72, thereby ejecting the sheaf of recording media bound by the binding processing unit 72 to the sheaf ejecting tray 68. Here, the ejection control unit 213 acquires a signal from the remaining quantity sensor 75 and determines whether the remaining quantity sensor 75 has detected that the remaining number of the ring binding members 80 has become N. When it is not detected that the remaining number of the ring binding members 80 has become N, the ejection control unit 213 notifies the printer 10 of a request for continued printing. On the other hand, when it is detected that the remaining number of the ring binding members 80 has become N, the ejection control unit 213 notifies the printer 10 of a deactivate request of printing.

The external I/F unit 205 allows the post-processing device control unit 200 to communicate with the printer control unit 100.

In the printing system of the embodiment, initial data such as the number N of the ring binding members 80 where the post-processing device 20 enters the binding member end state is sent from the post-processing device control unit 200 to the printer control unit 100 via the external I/F units 205 and 105 when printing starts. This initial data is stored, for example, in the RAM 102 of the printer control unit 100.

In the printer 10, the paper feeding control unit 113 controls paper feeding of a recording medium to the conveyance path P with the conveyance control unit 112 controlling conveyance of the recording medium and the printing control unit 111 controlling the printing process once printing starts. As a result, the recording medium on which an image has been printed by the printer 10 is sequentially conveyed to the post-processing device 20. Note that information on the recording medium subjected to paper feeding is stored, for example, in the RAM 102 of the printer control unit 100. The paper feeding control unit 113 refers to the information on the recording medium stored in the RAM 102 upon paper feeding of the recording medium or the initial data sent from the post-processing device control unit 200, and controls paper feeding of the recording medium to the conveyance path P.

Also in the post-processing device 20, the conveyance control unit 212 controls conveyance of the recording medium with the binding control unit 211 controlling the ring binding processing and the ejection control unit 213 controlling ejection of the sheaf of bound recording media. As a result, the sheaf of recording media bound by the post-processing device 20 is loaded on the sheaf ejecting tray 68. Here, when the remaining quantity sensor 75 detects that the remaining number of the ring binding members 80 has become N upon ejection of the sheaf of bound recording media to the sheaf ejecting tray 68, the post-processing device 20 enters the binding member end state. When the post-processing device 20 enters the binding member end state, the deactivate request of printing is sent from the post-processing device control unit 200 to the printer control unit 100 via the external I/F units 205 and 105. In this case, the paper feeding control unit 113 halts paper feeding of a recording medium. When printing finishes on the recording media having been already fed, printing in the printer 10 is halted.

Furthermore, in the printing system of the embodiment, the paper feeding control unit 113 limits paper feeding also when it is not detected that the remaining number of the ring binding members 80 has become N, namely, when the post-processing device 20 has not entered the binding member end state. Specifically, the paper feeding control unit 113 limits the number of recording media fed to the conveyance path P when the post-processing device 20 has not entered the binding member end state such that the number of recording media in the conveyance path P is equal to or less than the number of recording media processed by the sheaf processing unit 70 with N+1 ring binding members 80.

For example, when the number N of the ring binding members 80 where the post-processing device 20 enters the binding member end state is 5 and the number of recording media to be included in a sheaf is 2 (two sheets are included in one sheaf), the paper feeding control unit 113 limits the number of recording media fed to the conveyance path P such that the number of recording media in the conveyance path P is equal to or less than twelve (six sheaves) when the post-processing device 20 has not entered the binding member end state. Performing such control allows for keeping the number of recording media, which have already been fed and are remaining in the conveyance path P when the post-processing device 20 enters the binding member end state, equal to or less than the number of recording media that can be processed with the remaining ring binding member 80. Therefore, even when the number of recording media that can be simultaneously conveyed is larger due to the longer conveyance path P, paper jam occurrence due to conveyance of excessive recording media can be effectively avoided.

Such paper feeding control of the embodiment can be performed, for example, as follows. That is, the paper feeding control unit 113 first determines whether the number of sheaves designated by the job for ring binding is larger than N+1 when printing starts in a ring binding mode. When the number of sheaves designated by the job for ring binding is larger than N+1, recording media for the first (N+1) sheaves are fed while paper feeding of recording media for the (N+2)th and subsequent sheaves enters a standby state. For example, when N=5, recording media for the first six sheaves are fed while paper feeding of recording media for the seventh and subsequent sheaves enters the standby state.

Thereafter, the recording media to be included in the first sheaf are subjected to processing with the ring binding member 80 in the post-processing device 20 and the first sheaf of bound recording media is ejected to the sheaf ejecting tray 68, whereupon the ejection control unit 213 notifies of the request for continued printing. Paper feeding of recording media for the (N+2)th sheaf (e.g. seventh sheaf) is then performed. Thereafter, by repeating similar processing, paper feeding control of recording media for the (N+3) th (e.g. eighth) and subsequent sheaves is further performed. Here, when the ejection control unit 213 notifies of the deactivate request of printing, the paper feeding control unit 113 halts paper feeding of a recording medium and waits for the ring binding member 80 to be replenished. When it is confirmed that the ring binding member 80 is replenished, paper feeding of a recording medium is restarted and similar processing is repeated.

Note that when the number of sheaves designated by the job for ring binding is N+1 or less or when no ring binding is performed (printing not in the ring binding mode), the paper feeding control unit 113 is not required to limit paper feeding as described above.

Also, it is assumed in the above description that the length of the conveyance path P is long enough to simultaneously convey recording media of a larger number than the number of recording media processed by the post-processing device 20 with N ring binding members 80. However, there may be a case where the length of the conveyance path P is short depending on a configuration of the printer 10, such as when the number of the paper feeding units 12 connected to the main unit 11 is small and thus the number of recording media that can be simultaneously conveyed is equal to or less than the number of recording media processed by the post-processing device 20 with N ring binding members 80. Therefore, the paper feeding control unit 113 may be configured to switch, according to the configuration of the printer 10, whether to limit the number of recording media fed to the conveyance path P when the remaining quantity sensor 75 does not detect that the remaining number of the ring binding members 80 has become N. That is, when the length of the conveyance path P is short due to the configuration of the printer 10, paper feeding may not be limited as performed when the post-processing device 20 has not entered the binding member end state.

Here, a specific example of paper feeding control of the embodiment will be described in comparison with the conventional art with reference to FIGS. 7 and 8. FIG. 7 is a diagram illustrating a specific example of paper feeding control of the conventional art. FIG. 8 is a diagram illustrating a specific example of paper feeding control of the embodiment. Note that FIGS. 7 and 8 illustrate ring binding processing where paper feeding is performed from a paper feeding tray in most upstream of a printing system and one sheaf of recording media is generated from two recording media. Also, the number N of the ring binding members 80 where a post-processing device 20 enters the binding member end state is defined as 5. An expression "s$\alpha$–$\beta$" (where $\alpha$ and $\beta$ are numbers) in the figures denotes the $\beta$th recording medium in the $\alpha$th sheaf.

In paper feeding control of the conventional art illustrated in FIG. 7, paper feeding of a recording medium to a conveyance path P is performed unconditionally as long as the post-processing device 20 has not entered the binding member end state. Therefore, in a configuration where a conveyance path P is long, there may be a case where recording media of a larger number than the number of recording media that can be bound with the remaining five ring binding members 80 have already been fed to the conveyance path P when it is detected that the remaining number of the ring binding members 80 equals 5 and the post-processing device 20 enters the binding member end state. For example, when it is detected that the remaining number of the ring binding members 80 equals 5 upon ejection of the first sheaf of recording media to the sheaf ejecting tray 68, although no binding can be performed on recording media for the seventh and subsequent sheaves, recording media for the first nine sheaves have already been fed to the conveyance path P in the example in FIG. 7. Therefore, the recording media for the seventh to ninth sheaves may be retained in the conveyance path P, thereby disadvantageously causing paper jam.

On the other hand, in paper feeding control of the embodiment as illustrated in FIG. 8, the paper feeding control unit 113 limits paper feeding, to the conveyance path P, of recording media which cannot be bound with the remaining ring binding member 80 after the post-processing device 20 enters the binding member end state, when the post-processing device 20 has not entered the binding member end state. That is, when printing starts, there is a possibility that it is detected that the remaining number of the ring binding members 80 equals 5 upon ejection of the first sheaf of recording media to the sheaf ejecting tray 68 and the post-processing device 20 enters the binding member end state. Therefore, recording media for the first six sheaves, which can be bound with the remaining five ring binding members 80 after the post-processing device 20 enters the binding member end state, are fed to the conveyance path P while the recording media for the seventh and subsequent sheaves stand by in the paper feeding tray. When it is not detected that the remaining number of the ring binding members 80 equals 5 upon ejection of the first sheaf of recording media to the sheaf ejecting tray 68, recording media for the seventh sheaf are fed to the conveyance path P. Furthermore, when it is not detected that the remaining number of the ring binding members 80 equals 5 upon ejection of the second sheaf of recording media to the sheaf ejecting tray 68, recording media for the eighth sheaf are fed to the conveyance path P.

Thereafter, such paper feeding control is repeated until it is detected that the remaining number of the ring binding members 80 equals 5, whereupon paper feeding of a recording medium is halted. Also, binding and ejecting of recording media that have already been fed to the conveyance path P are completed. When a user completes replenishing the ring binding member 80, paper feeding of a recording medium is restarted. The aforementioned paper feeding control allows for keeping the number of recording media in the conveyance path P equal to or less than the number of recording media that can be bound with the remaining ring binding member 80, thereby effectively avoiding paper jam occurrence due to conveyance of excessive recording media.

FIG. 9 is a flowchart describing a processing procedure of paper feeding control of the embodiment. A flow of a series of processing performed on respective recording media subjected to paper feeding is illustrated. An example of operations of the printing system of the embodiment will be described below along the flowchart in FIG. 9.

When printing starts in the ring binding mode, first in step S101, it is determined whether the post-processing device 20 is in the binding member end state. If the post-processing device 20 is in the binding member end state (Yes in step S101), determination in step S101 is repeated until the binding member end state is canceled. On the other hand, if the post-processing device 20 is not in the binding member end state (No in step S101), the flow proceeds to next step S102. The binding member end state is a state where it is detected that the remaining number of the ring binding members 80 has become N and the post-processing device 20 has notified the printer 10 of the deactivate request of printing. The binding member end state is canceled by replenishment of the ring binding member 80 by a user.

In step S102, it is determined whether a sheaf feeding count is equal to or less than N. The sheaf feeding count denotes the number of sheaves to be obtained from recording media having been fed to the conveyance path P but yet to be bound. If the sheaf feeding count is equal to or less than N (Yes in step S102), the flow proceeds to next step S103. On the other hand, if the sheaf feeding count is larger than N (No in step S102), determination in step S102 is repeated until the sheaf feeding count becomes equal to or less than N. This is the state where paper feeding of a recording medium is limited.

In step S103, paper feeding of a recording medium to the conveyance path P from the paper feeding tray is executed, whereupon the flow proceeds to next step S104.

In step S104, it is determined whether the recording medium fed to the conveyance path P in step S103 is the first recording medium (leading recording medium) in a sheaf. If the recording medium is the first recording medium in the sheaf (Yes in step S104), the flow proceeds to next step S105. If the recording medium is not the first recording medium in the sheaf (No in step S104), the flow proceeds to step S106.

In step S105, the sheaf feeding count is incremented by one, whereupon the flow proceeds to next step S106.

In step S106, the recording medium fed to the conveyance path P in step S103 is conveyed from the printer 10 to the post-processing device 20 and then ejected to the sheaf processing tray 71 of the post-processing device 20, whereupon the flow proceeds to next step S107.

In step S107, it is determined whether the recording medium ejected to the sheaf processing tray 171 in step S106 is the last recording medium (ending recording medium) in the sheaf. If the recording medium is the last recording medium in the sheaf (Yes in step S107), the flow proceeds to next step S108. If the recording medium is not the last recording medium in the sheaf (No in step S107), the processing illustrated by the flowchart in FIG. 9 ends.

In step S108, binding processing with the ring binding member 80 (ring binding processing) is executed on recording media collected in the sheaf processing tray 171 for inclusion in the sheaf, whereupon the flow proceeds to next step S109.

In step S109, the sheaf feeding count is decremented by one, whereupon the flow proceeds to next step S110.

In step S110, the sheaf of recording media bound in step S108 is ejected to the sheaf ejecting tray 68, whereupon the flow proceeds to next step S111.

In step S111, it is determined whether the remaining quantity of the ring binding members 80 is larger than N. If the remaining number of the ring binding members 80 is larger than N (Yes in step S111), the processing illustrated by the flowchart in FIG. 9 ends. On the other hand, if the remaining number of the ring binding members 80 equals N (No in step S111), the post-processing device 20 transfers to the binding member end state in next step S112, whereupon the processing illustrated by the flowchart in FIG. 9 ends.

As described above in detail with the specific example, in the printing system of the embodiment, the number of recording media fed to the conveyance path P is limited when it is not detected that the remaining number of the ring binding members 80 has become N such that the number of recording media in the conveyance path P is equal to or less than the number of recording media processed by the sheaf processing unit 70 with N+1 ring binding members 80. Therefore, according to the printing system of the embodiment, even when the number of recording media that can be simultaneously conveyed is larger due to the longer conveyance path P, paper jam occurrence due to conveyance of excessive recording media can be effectively avoided.

Note that the example of ring binding, where the number of binding members used for generating one sheaf of recording media is one, has been described above. However, for example in the case of saddle stitching binding, a plurality of binding members (staple needles) is generally used for generating one sheaf of recording media. When using a post-processing device 20 where a plurality of binding members is used for generating one sheaf of recording media as above, it is only required to limit the number of recording media fed to a conveyance path P, when it is not detected that the remaining number of the binding members has become N, such that the number of recording media in the conveyance path P is equal to or less than the sum of the number of recording media processed with N binding members and the number of recording media to be included in one sheaf. That is, the paper feeding control unit 113 limits the number of recording media fed to the conveyance path P, when it is not detected that the remaining number of the binding members has become N, such that the number of recording media in the conveyance path P is equal to or less than the number of recording media processed by the sheaf processing unit 70 with N+M binding members (where M is the number of binding members used for generating one sheaf). This allows for keeping the number of recording media having been fed to the conveyance path P equal to or less than the number of recording media processed with N binding members when the remaining number of the binding members equals N, thereby effectively avoiding paper jam occurrence due to conveyance of excessive recording media.

Second Embodiment

Next, a printing system according to a second embodiment will be described. In the printing system of the embodiment, the number of recording media fed to a conveyance path P is limited, when it is not detected that the remaining number of ring binding members 80 has become N, such that the number of recording media in the conveyance path P is equal to or less than the sum of the number of recording media processed by a sheaf processing unit 70 with N+1 ring binding members 80 and the number of recording media that can stand by in the sheaf processing unit 70. Note that a configuration and basic operations of the printing system are similar to those of the first embodiment and thus duplicate descriptions are omitted as appropriate.

The sheaf processing unit 70 of a post-processing device 20 includes a sheaf processing tray 71 as described above. A recording medium conveyed to the post-processing device 20 and in which holes have been punched stands by at this sheaf processing tray 71 until all the recording media to be included in a sheaf are collected. Therefore, even when no ring binding member 80 is remaining and thus no ring binding processing can be performed, recording media to be included in one sheaf can stand by in this sheaf processing tray 71. That is, paper feeding is controlled such that the number of recording media in the conveyance path P is equal to or less than the sum of the number of recording media processed by the sheaf processing unit 70 with N+1 ring binding members 80 and the number of recording media that can stand by in the sheaf processing tray 71 for inclusion in one sheaf, thereby effectively avoiding paper jam occurrence after a binding member end state is entered.

A specific example of paper feeding control of the embodiment will be described with reference to FIGS. 10 and 11. FIGS. 10 and 11 are diagrams illustrating the specific example of paper feeding control of the embodiment. As in the specific example of paper feeding control of the first embodiment illustrated in FIG. 8, illustrated is the example where ring binding processing is performed while paper feeding is performed from a paper feeding tray in most upstream of the printing system and one sheaf of recording media is generated from two recording media. Here, the number N of the ring binding members 80 where the post-processing device 20 enters a binding member end state is also defined as 5. An expression "s$\alpha$–$\beta$" (where $\alpha$ and $\beta$ are numbers) in the figures also denotes the $\beta$th recording medium in the $\alpha$th sheaf. Signs b1 to b6 in FIG. 11 denote sheaves of recording media (the first to sixth sheaves) subjected to ring binding and ejected to a sheaf ejecting tray 68.

In paper feeding control of the embodiment, as illustrated in FIG. 10, recording media for the first seven sheaves are fed to the conveyance path P when printing starts while recording media for the eighth and subsequent sheaves stand by in the paper feeding tray. Thereafter, when it is detected that the remaining number of the ring binding members 80 equals 5 upon ejection of the first sheaf of recording media to the sheaf ejecting tray 68, the second to sixth sheaves of recording media are bound with the remaining five ring binding members 80 and ejected to the sheaf ejecting tray 68. Also, the recording media, for the seventh sheaf, already fed to the conveyance path P stand by in the sheaf processing tray 71 of the sheaf processing unit 70 as illustrated in FIG. 11. As a result, no recording medium is retained in the conveyance path P after the post-processing device 20 enters the binding member end state, thereby effectively avoiding paper jam occurrence due to conveyance of excessive recording media. When a user replenishes the ring binding member 80 and the binding member end state is canceled, the recording media standing by in the sheaf processing tray 71 can immediately be bound.

Note that when it is not detected that the remaining number of the ring binding members 80 equals 5 upon ejection of the sheaf of bound recording media to the sheaf ejecting tray 68, as in the first embodiment, paper feeding is performed on recording media for the subsequent sheaf that have been in the standby state without being fed. Thereafter, similar paper feeding control is repeated until it is detected that the remaining number of the ring binding members 80 equals 5. When it is detected that the remaining number of the ring binding members 80 equals 5, paper feeding of a recording medium is halted and binding and ejecting of recording media that have already been fed to the conveyance path P are completed. When a user completes replenishing the ring binding member 80, paper feeding of a recording medium is restarted.

FIG. 12 is a flowchart describing a processing procedure of paper feeding control of the embodiment. A flow of a series of processing performed on respective recording media subjected to paper feeding is illustrated. An example of operations of the printing system of the embodiment will be described below along the flowchart in FIG. 12.

When printing starts in a ring binding mode, first in step S201, it is determined whether the post-processing device 20 is in the binding member end state. If the post-processing device 20 is in the binding member end state (Yes in step S201), determination in step S201 is repeated until the binding member end state is canceled. On the other hand, if the post-processing device 20 is not in the binding member end state (No in step S201), the flow proceeds to next step S202.

In step S202, it is determined whether a sheaf feeding count is equal to or less than N+1. If the sheaf feeding count is equal to or less than N+1 (Yes in step S202), the flow proceeds to next step S203. On the other hand, if the sheaf feeding count is larger than N+1 (No in step S202), determination in step S202 is repeated until the sheaf feeding count becomes equal to or less than N+1. This is the state where paper feeding of a recording medium is limited.

In step S203, paper feeding of a recording medium to the conveyance path P from the paper feeding tray is executed, whereupon the flow proceeds to next step S204.

In step S204, it is determined whether the recording medium fed to the conveyance path P in step S203 is the first recording medium in a sheaf. If the recording medium is the first recording medium in the sheaf (Yes in step S204), the flow proceeds to next step S205. If the recording medium is not the first recording medium in the sheaf (No in step S204), the flow proceeds to step S206.

In step S205, the sheaf feeding count is incremented by one, whereupon the flow proceeds to next step S206.

In step S206, the recording medium fed to the conveyance path P in step S203 is conveyed from a printer 10 to the post-processing device 20 and then ejected to the sheaf processing tray 71 of the post-processing device 20, whereupon the flow proceeds to next step S207.

In step S207, it is determined whether the post-processing device 20 is in the binding member end state. If the post-processing device 20 is not in the binding member end state (No in step S207), the flow proceeds to next step S208. On the other hand, if the post-processing device 20 is in the binding member end state (Yes in step S207), determination in step S207 is repeated until the binding member end state is canceled. This is the state where recording media, which cannot be bound with the remaining ring binding member 80 after the post-processing device 20 enters the binding member end state, stand by in the sheaf processing tray 71.

In step S208, it is determined whether the recording medium ejected to the sheaf processing tray 71 in step S206 is the last recording medium in the sheaf. If the recording medium is the last recording medium in the sheaf (Yes in step S208), the flow proceeds to next step S209. If the recording medium is not the last recording medium in the sheaf (No in step S208), the processing illustrated by the flowchart in FIG. 12 ends.

In step S209, binding processing with the ring binding member 80 (ring binding processing) is executed on recording media collected in the sheaf processing tray 71 for inclusion in one sheaf, whereupon the flow proceeds to next step S210.

In step S210, the sheaf feeding count is decremented by one, whereupon the flow proceeds to next step S211.

In step S211, the sheaf of recording media bound in step S209 is ejected to the sheaf ejecting tray 68, whereupon the flow proceeds to next step S212.

In step S212, it is determined whether the remaining quantity of the ring binding members 80 is larger than N. If the remaining number of the ring binding members 80 is larger than N (Yes in step S212), the processing illustrated by the flowchart in FIG. 12 ends. On the other hand, if the remaining number of the ring binding members 80 equals N (No in step S212), the post-processing device 20 transfers to the binding member end state in next step S213, whereupon the processing illustrated by the flowchart in FIG. 12 ends.

As described above in detail with the specific example, in the printing system of the embodiment, the number of recording media fed to the conveyance path P is limited when it is not detected that the remaining number of the ring binding members 80 has become N such that the number of recording media in the conveyance path P is equal to or less than the sum of the number of recording media processed by the sheaf processing unit 70 with N+1 ring binding members 80 and the number of recording media that can stand by in the sheaf processing unit 70. Therefore, according to the printing system of the embodiment, even when the number of recording media that can be simultaneously conveyed is larger due to the longer conveyance path P, paper jam occurrence due to conveyance of excessive recording media can be effectively avoided.

Note that when using a post-processing device 20 where a plurality of binding members is used for generating one sheaf of recording media, a paper feeding control unit 113 is only required to limit the number of recording media fed to a conveyance path P, when it is not detected that the remaining number of the binding members has become N, such that the number of recording media in the conveyance path P is equal to or less than the sum of the number of recording media processed by a sheaf processing unit 70 with N+M (where M is the number of binding members used for generating one sheaf) binding members and the number of recording media that can stand by in the sheaf processing unit 70. As a result, paper jam occurrence due to conveyance of excessive recording media can be effectively avoided.

Third Embodiment

Next, a printing system according to a third embodiment will be described. In the printing system of the embodiment, whether to perform the aforementioned paper feeding control of the first embodiment or the second embodiment is switched according to a user's choice. When the aforementioned paper feeding control of the first embodiment or the second embodiment is not performed, similar paper feeding to that of the conventional art is performed until a post-processing device 20 enters a binding member end state. Once the post-processing device 20 enters the binding member end state, an extra recording medium that cannot be conveyed to the post-processing device 20 is ejected to a disposal tray 37 in a printer 10.

In the printing system of the embodiment, a user operation selecting one of a first method and a second method as a method of conveying a recording medium is accepted by an operation panel 15. When the first method is selected by the user, a paper feeding control unit 113 performs the aforementioned paper feeding control of the first embodiment or the second embodiment, namely, limits paper feeding as when the post-processing device 20 has not entered the binding member end state. On the other hand, when the second method is selected by the user, similar paper feeding to that of the conventional art is performed until the post-processing device 20 enters the binding member end state. Once the post-processing device 20 enters the binding member end state and if there is a recording medium, among recording media having been fed, that cannot be bound with the remaining ring binding member 80, namely, an extra recording medium that may cause paper jam if conveyed to the post-processing device 20, such a recording medium is ejected to the disposal tray 37 in the printer 10 as a disabled paper.

In the aforementioned paper feeding control of the first embodiment or the second embodiment, since paper feeding is limited when the post-processing device 20 has not entered the binding member end state, there is a concern over decreased productivity. In the embodiment, therefore, whether to perform the aforementioned paper feeding control of the first embodiment or the second embodiment can be selected when the user places more priority on productivity. Moreover, when the user selects not to perform the paper feeding control of the first embodiment or the second embodiment, the extra recording medium is ejected to the disposal tray 37 in the printer 10 as the disabled paper when the post-processing device 20 enters the binding member end state, thereby avoiding paper jam occurrence.

Operations of the printing system of the embodiment when the user selects not to perform the aforementioned paper feeding control of the first embodiment or the second embodiment (the second method is selected) will be described below. FIGS. 13 and 14 are diagrams illustrating a specific example of operations of the embodiment. As in the specific example of paper feeding control of the first embodiment illustrated in FIG. 8, illustrated is the example where ring binding processing is performed while paper feeding is performed from a paper feeding tray in most upstream of the printing system and one sheaf of recording media is generated from two recording media. Here, the number N of the ring binding members 80 where the post-processing device 20 enters the binding member end state is also defined as 5. An expression "sα–β" (where α and β are numbers) in the figures also denotes the βth recording medium in the αth sheaf. Signs b1 to b6 in FIG. 14 denote sheaves of recording media (the first to sixth sheaves) subjected to ring binding and ejected to a sheaf ejecting tray 68.

In the embodiment, when the second method is selected, similar paper feeding control to that of the conventional art illustrated in FIG. 7 is performed while the post-processing device 20 is not in the binding member end state as illustrated in FIG. 13. Therefore, in a configuration where a conveyance path P is long, there may be a case where recording media of a larger number than the number of recording media that can be bound with the remaining five ring binding members 80 have already been fed to the conveyance path P when it is detected that the remaining number of the ring binding members 80 equals 5 and the post-processing device 20 enters the binding member end state. For example, when it is detected that the remaining number of the ring binding members 80 equals 5 upon ejection of the first sheaf of recording media to the sheaf ejecting tray 68, although no binding can be performed on recording media for the seventh and subsequent sheaves, recording media for the first nine sheaves have already been fed to the conveyance path P in the example in FIG. 13. If these recording media that cannot be bound are conveyed to the post-processing device 20, this may cause paper jam occurrence.

Therefore, in the embodiment, when the post-processing device 20 enters the binding member end state and if there is a recording medium that cannot be bound with the remaining ring binding member 80 in the conveyance path P, such a recording medium is ejected to the disposal tray 37 in the printer 10 as the disabled paper without being conveyed to the post-processing device 20 as illustrated in FIG. 14. This allows for avoiding a disadvantage of paper jam occurrence due to conveyance of the recording medium, which cannot be bound, to the post-processing device 20 after the post-processing device 20 enters the binding member end state. Furthermore, in the embodiment, since the paper feeding is not limited as is limited when the post-processing device 20 has not entered the binding member end state, productivity does not decrease. However, processing is required such that the recording medium ejected to the disposal tray 37 as the disabled paper is disposed of.

FIG. 15 is a flowchart describing a processing procedure of paper feeding control when the second method is selected as the method of conveying a recording medium in the embodiment. A flow of a series of processing performed on respective recording media subjected to paper feeding is illustrated. An example of operations of the printing system of the embodiment when the second method is selected will be described below along this flowchart in FIG. 15.

When printing starts in a ring binding mode, first in step S301, it is determined whether the post-processing device 20 is in the binding member end state. If the post-processing device 20 is in the binding member end state (Yes in step S301), determination in step S301 is repeated until the binding member end state is canceled. On the other hand, if the post-processing device 20 is not in the binding member end state (No in step S301), the flow proceeds to next step S302.

In step S302, paper feeding of a recording medium to the conveyance path P from the paper feeding tray is executed, whereupon the flow proceeds to next step S303.

In step S303, it is determined whether the post-processing device 20 is in the binding member end state. If the post-processing device 20 is not in the binding member end state (No in step S303), the flow proceeds to next step S304. If the post-processing device 20 is in the binding member end state (Yes in step S303), the flow proceeds to step S311.

In step S304, it is determined whether a position of the recording medium fed to the conveyance path P in step S302 is before a paper ejection bifurcating point (a point bifurcating into a path to an ejection unit 36 and a path to a reversing unit 43 of the printer 10) in the conveyance path P. If the position of the recording medium is before the paper ejection bifurcating point (Yes in step S304), the flow returns to step S303 where determination as to whether the post-processing device 20 is in the binding member end state is repeated. On the other hand, if the position of the recording medium is after the paper ejection bifurcating point (No in step S304), the flow proceeds to next step S305.

In step S305, the recording medium fed to the conveyance path P in step S302 is conveyed from the printer 10 to the post-processing device 20 and then ejected to a sheaf processing tray 71 of the post-processing device 20, whereupon the flow proceeds to next step S306.

In step S306, it is determined whether the recording medium ejected to the sheaf processing tray 71 in step S305 is the last recording medium in a sheaf. If the recording medium is the last recording medium in the sheaf (Yes in step S306), the flow proceeds to next step S307. If the recording medium is not the last recording medium in the sheaf (No in step S306), the processing illustrated by the flowchart in FIG. 15 ends.

In step S307, binding processing with the ring binding member 80 (ring binding processing) is executed on recording media collected in the sheaf processing tray 71 for inclusion in the sheaf, whereupon the flow proceeds to next step S308.

In step S308, the sheaf of recording media bound in step S307 is ejected to the sheaf ejecting tray 68, whereupon the flow proceeds to next step S309.

In step S309, it is determined whether the remaining quantity of the ring binding members 80 is larger than N. If the remaining number of the ring binding members 80 is larger than N (Yes in step S309), the processing illustrated by the flowchart in FIG. 15 ends. On the other hand, if the remaining number of the ring binding members 80 equals N (No in step S309), the post-processing device 20 transfers to the binding member end state in next step S310, whereupon the processing illustrated by the flowchart in FIG. 15 ends.

In step S311, it is determined whether the recording medium fed to the conveyance path P in step S302 can be bound (the recording medium that can be bound with the remaining ring binding member 80). If the recording medium can be bound (Yes in step S311), the flow proceeds to step S305, where ejection to the sheaf processing tray 71 is performed. On the other hand, if the recording medium cannot be bound (No in step S311), the flow proceeds to next step S312.

In step S312, the recording medium fed to the conveyance path P in step S302 is ejected to the disposal tray 37 in the printer 10 as the disabled paper, whereupon the processing illustrated by the flowchart in FIG. 15 ends.

As described above in detail with the specific example, in the printing system of the embodiment, similar paper feeding control to that of the aforementioned first embodiment or the second embodiment is performed when the first method is selected as the method of conveying a recording medium. When the second method is selected, paper feeding is not limited as is limited when the post-processing device 20 has not entered the binding member end state and, once the post-processing device 20 enters the binding member end state, the extra recording medium that cannot be conveyed to the post-processing device 20 is ejected to the disposal tray 37 in the printer 10. Therefore, according to the printing system of the embodiment, a decrease in productivity can be suppressed when productivity is given a higher priority while paper jam occurrence due to conveyance of excessive recording media is effectively avoided.

Fourth Embodiment

Next, a printing system according to a fourth embodiment will be described. The printing system of the embodiment is an example where a stacker is used as a post-processing device 20. The stacker loads a recording medium, printed by a printer 10, in a medium loading unit in an aligned manner. The post-processing device configured as the stacker is hereinafter denoted as a post-processing device 20A in order to distinguish from the post-processing device 20 of the other embodiments.

In the post-processing device 20A configured as the stacker, an attempt to load recording media in the medium loading unit in excess of a loading capacity may result in a failure such as stacking failure, deterioration of the recording medium, or a stuck paper ejection tray. Therefore, when it is detected that a loading quantity in the medium loading unit equals a predetermined quantity (a loading quantity smaller than the loading capacity), the printer 10 is notified of a deactivate request of printing, whereupon printing is halted. Only the recording medium having been already fed is then loaded in the medium loading unit. However, in a printing system having a configuration where a conveyance path P is long, more recording media than the number of recording media that can be loaded in the medium loading unit in excess of the predetermined quantity may be simultaneously conveyed, in which case there is a concern over paper jam occurrence due to conveyance of excessive recording media to the post-processing device 20A.

Therefore, in the embodiment, similar paper feeding control to that in the aforementioned other embodiments is applied to the printing system using such a post-processing device 10A, thereby limiting paper feeding when it is not detected that the loading quantity in the medium loading unit has become the predetermined quantity. That is, the number of recording media fed to the conveyance path P is limited when it is not detected that the loading quantity in the medium loading unit has become the predetermined quantity such that the number of recording media in the conveyance path P is equal to or less than the number of recording media that can be loaded in the medium loading unit in excess of the predetermined quantity. The state where it is detected that the loading quantity in the medium loading unit has become the predetermined quantity is hereinafter referred to as a "stacker full state." When the post-processing device 20A enters the stacker full state, the post-processing device 20A notifies the printer 10 of the deactivate request of printing, whereupon printing is halted.

FIG. 16 is a diagram illustrating an exemplary configuration of the post-processing device 20A configured as the stacker. As illustrated in FIG. 16, the post-processing device 20A includes a medium loading unit 95. A large number of recording media (for example, up to approximately 5000 sheets) can be loaded on a shift tray 96 of the medium loading unit 95. The medium loading unit 95 is provided with a carriage unit 97, thus allowing the medium loading unit 95 to be pulled out from a main body of the post-processing device 20A and the recording media loaded on the shift tray 96 can be unloaded therefrom.

A recording medium printed by the printer 10 and ejected therefrom is detected by an inlet sensor 91 and then conveyed into the inner part of the post-processing device 20A. The recording medium conveyed into the inner part of the post-processing device 20A is conveyed along a conveyance path P in the post-processing device 20A toward a proof ejection unit 93, toward an outlet sensor 94 provided near an outlet connecting to a downstream post-processing device, or toward the medium loading unit 95, by operation of a bifurcating claw 92.

The recording medium conveyed toward the medium loading unit 95 is loaded on the shift tray 96 of the medium loading unit 95. The medium loading unit 95 is provided with loading position sensors 98*a*, 98*b*, 98*c*, and 98*d* for detecting, at multiple levels, a loading quantity of the recording media on the shift tray 96. For example, the loading position sensor 98*a* detects a loading quantity of 25%, the loading sensor 98*b* detects a loading quantity of 50%, the loading position sensor 98*c* detects a loading quantity of 75%, and the loading sensor 98*d* detects a loading quantity of 100%. The shift tray 96 descends according to the loading quantity detected by these loading position sensors 98*a*, 98*b*, 98*c*, and 98*d*. When the loading position sensor 98*d* detects the loading quantity of 100%, the post-processing device 20A enters the stacker full state. Even after the post-processing device 20A enters the stacker full state, a small number of recording media can be loaded in the medium loading unit 95. The embodiment leverages this attribute and performs similar paper feeding control to that in the aforementioned other embodiments.

A specific example of paper feeding control of the embodiment will be described with reference to FIG. 17. FIG. 17 is a diagram illustrating a specific example of paper feeding control of the embodiment. Note that FIG. 17 illustrates that paper feeding is performed from a paper feeding tray in most upstream of a printing system and a recording medium printed by the printer 10 is ejected to the medium loading unit 95 of the post-processing device 20A. Furthermore, the maximum number of recording media that can be loaded in the medium loading unit 95 after the post-processing device 20A enters a stacker full state is assumed as twelve sheets. An expression "sγ" (where γ is a number) in the figure denotes the γth recording medium.

In paper feeding control of the embodiment, as illustrated in FIG. 17, the first twelve recording media, which can be loaded in the medium loading unit 95 after the post-processing device 20A enters the stacker full state, are fed to a conveyance path P while the thirteenth and subsequent recording media stand by in the paper feeding tray, when the post-processing device 20A has not entered the stacker full state. Thereafter, each time the recording medium printed by the printer 10 is ejected to the medium loading unit 95 of the post-processing device 20A, it is determined whether the post-processing device 20A has entered the stacker full state. If the post-processing device 20A has not entered the stacker full state, the thirteenth and subsequent recording media are sequentially fed to the conveyance path P. This allows for keeping the number of recording media in the conveyance path P when the post-processing device 20A enters the stacker full state equal to or less than the number of recording media that can be loaded in the medium loading unit 95, thereby effectively avoiding paper jam occurrence due to conveyance of excessive recording media.

FIG. 18 is a flowchart describing a processing procedure of paper feeding control of the embodiment. A flow of a series of processing performed on respective recording media subjected to paper feeding is illustrated. An example of operations of the printing system of the embodiment will be described below along the flowchart in FIG. 18.

When printing starts, first in step S401, it is determined whether the post-processing device 20A is in the stacker full state. If the post-processing device 20A is in the stacker full state (Yes in step S401), determination in step S401 is repeated until the stacker full state is canceled. On the other hand, if the post-processing device 20A is not in the stacker full state (No in step S401), the flow proceeds to next step S402. The stacker full state is a state where it is detected that a loading quantity in the medium loading unit 95 has become the predetermined quantity and the post-processing device 20A has notified the printer 10 of the deactivate request of printing. The stacker full state is canceled when the user pulls out the medium loading unit 95 and unloads the recording media on the shift tray 96.

In step S402, it is determined whether a paper feeding count is equal to or less than X. The paper feeding count denotes the number of recording media having been fed to the conveyance path P but yet to be ejected to the medium loading unit 95 of the post-processing device 20A. X denotes the maximum number of recording media that can be loaded in the medium loading unit 95 in excess of the predetermined quantity. If the paper feeding count is equal to or less than X (Yes in step S402), the flow proceeds to next step S403. On the other hand, if the paper feeding count is more than X (No in step S402), determination in step S402 is repeated until the paper feeding count becomes equal to or less than X. This is the state where paper feeding of a recording medium is limited.

In step S403, paper feeding of a recording medium to the conveyance path P from the paper feeding tray is executed, whereupon the flow proceeds to next step S404.

In step S404, the paper feeding count is incremented by one, whereupon the flow proceeds to next step S405.

In step S405, the recording medium fed to the conveyance path P and conveyed to the post-processing device 20A in step S403 is ejected to the medium loading unit 95, whereupon the flow proceeds to next step S406.

In step S406, the paper feeding count is decremented by one, whereupon the flow proceeds to next step S407.

In step S407, it is determined whether the loading quantity in the medium loading unit 95 has reached the predetermined quantity. If the loading quantity in the medium loading unit 95 has not reach the predetermined quantity (No in step S407), the processing illustrated by the flowchart in FIG. 18 ends. On the other hand, if the loading quantity in the medium loading unit 95 has reached the predetermined quantity (Yes in step S407), the post-processing device 20A transfers to the stacker full state in next step S408, whereupon the processing illustrated by the flowchart in FIG. 18 ends.

Note that the above description is given on paper feeding control where the post-processing device 20A has not entered the stacker full state. However, as in the third embodiment, the present embodiment may also be configured to allow a user to select whether to control ejection of an extra recording medium which cannot be conveyed to the post-processing device 20A to a disposal tray 37 in the printer 10 when the post-processing device 20A enters the stacker full state without performing the aforementioned paper feeding control.

FIG. 19 is a flowchart describing a processing procedure when such control is selected. A flow of a series of processing performed on respective recording media subjected to paper feeding is illustrated.

When printing starts, first in step S501, it is determined whether the post-processing device 20A is in the stacker full state. If the post-processing device 20A is in the stacker full state (Yes in step S501), determination in step S501 is repeated until the stacker full state is canceled. On the other hand, if the post-processing device 20A is not in the stacker full state (No in step S501), the flow proceeds to next step S502.

In step S502, paper feeding of a recording medium to the conveyance path P from the paper feeding tray is executed, whereupon the flow proceeds to next step S503.

In step S503, the paper feeding count is incremented by one, whereupon the flow proceeds to next step S504.

In step S504, it is determined whether the post-processing device 20A is in the stacker full state. If the post-processing device 20A is not in the stacker full state (No in step S504), the flow proceeds to next step S505. If the post-processing device 20A is in the stacker full state (Yes in step S504), the flow proceeds to step S510.

In step S505, it is determined whether a position of the recording medium fed to the conveyance path P in step S502 is before a paper ejection bifurcating point (a point bifurcating into a path to an ejection unit 36 of the printer 10 and a path to a reversing unit 43) in the conveyance path P. If the position of the recording medium is before the paper ejection bifurcating point (Yes in step S505), the flow returns to step S504 where determination as to whether the post-processing device 20A is in the stacker full state is repeated. On the other hand, if the position of the recording medium is after the paper ejection bifurcating point (No in step S505), the flow proceeds to next step S506.

In step S506, the recording medium fed to the conveyance path P in step S502 is conveyed from the printer 10 to the post-processing device 20A and then ejected to the medium loading unit 95 of the post-processing device 20A, whereupon the flow proceeds to next step S507.

In step S507, the paper feeding count is decremented by one, whereupon the flow proceeds to next step S508.

In step S508, it is determined whether the loading quantity in the medium loading unit 95 has reached the predetermined quantity. If the loading quantity in the medium loading unit 95 has not reached the predetermined quantity (No in step S508), the processing illustrated by the flowchart in FIG. 19 ends. On the other hand, if the loading quantity in the medium loading unit 95 has reached the predetermined quantity (Yes in step S508), the post-processing device 20A transfers to the stacker full state in next step S509, whereupon the processing illustrated by the flowchart in FIG. 19 ends.

In step S510, it is determined whether the paper feeding count is equal to or less than X. If the paper feeding count is equal to or less than X (Yes in step S510), the flow proceeds to step S506, where ejection to the medium loading unit 95 is performed. On the other hand, if the paper feeding count is more than X (No in step S510), the flow proceeds to next step S511.

In step S511, the recording medium fed to the conveyance path P in step S502 is ejected to the disposal tray 37 in the printer 10 as a disabled paper, whereupon the processing illustrated by the flowchart in FIG. 19 ends.

As described above in detail with the specific example, in the printing system of the embodiment, the number of recording media fed to the conveyance path P is limited when it is not detected that the loading quantity in the medium loading unit 95 of the post-processing device 20A has reached the predetermined quantity such that the number of recording media in the conveyance path P is equal to or less than the number of recording media that can be loaded in the medium loading unit 95 in excess of the predetermined quantity. Therefore, according to the printing system of the embodiment, even when the number of recording media that can be simultaneously conveyed is larger due to the longer conveyance path P, paper jam occurrence due to conveyance of excessive recording media can be effectively avoided.

Also, the printing system of the embodiment allows a user to select whether to control to eject the extra recording medium, which cannot be conveyed to the post-processing device 20A, to the disposal tray 37 in the printer 10 when it is detected that the loading quantity in the medium loading unit 95 has reached the predetermined quantity, without limiting paper feeding as limiting when it is not detected that the loading quantity in the medium loading unit 95 has reached the predetermined quantity. As a result, a decrease in productivity can be suppressed when productivity is given a higher priority while paper jam occurrence due to conveyance of excessive recording media is effectively avoided.

Note that it is assumed in the above description that the number of recording media that can be loaded in the medium loading unit 95 in excess of the predetermined quantity is a fixed value. In practice, however, the number of recording media that can be loaded in the medium loading unit 95 in excess of the predetermined quantity is different depending on the thickness of the recording medium. Therefore, the number of recording media fed to the conveyance path P when it is not detected that the loading quantity in the medium loading unit 95 has reached the predetermined quantity may be changed according to the thickness of the recording medium.

Furthermore, it is assumed in the above description that the post-processing device 20A enters the stacker full state when the loading position sensor 98*d*, among the multiple loading position sensors 98*a*, 98*b*, 98*c*, and 98*d* provided to the medium loading unit 95, detects the loading quantity of 100%. That is, the predetermined quantity of the loading quantity in the medium loading unit 95 is assumed to be the loading quantity detected by the loading position sensor 98*d*. However, the loading quantity detected by another loading position sensor such as the loading quantity detected by the loading position sensor 98*c* may be set as the predetermined quantity, whereby the post-processing device 20A enters the stacker full state when that loading quantity is detected by the other loading position sensor. This increases the number of recording media that can be further loaded in the medium loading unit 95 after the post-processing device 20A enters the stacker full state, thereby further effectively avoiding paper jam occurrence due to conveyance of excessive recording media.

Although the specific embodiments of the invention have been described above, the aforementioned embodiments merely illustrate application examples of the invention. The invention is not limited to the aforementioned embodiments as they are but may be implemented with various modifications or alterations without departing from the principals of the invention in an implementation phase.

For example, the aforementioned embodiments illustrate examples where a functional component such as the paper feeding control unit 113 is implemented by using the control FPGA 110; however, the functional component such as the paper feeding control unit 113 may be implemented by a program (software). In this case for example, execution of the program by the CPU 101 with the RAM 102 illustrated in FIG. 6 results in implementation of the functional component such as the paper feeding control unit 113 on the RAM 102. The program may be provided, for example, by incorporation in the ROM 103 in advance. Alternatively, the program may be provided by being stored in a computer-readable recording medium such as a CD-ROM, flexible disk (FD), CD-R, or digital versatile disk (DVD) in a file format installable in or executable on the printer 10. Alternatively, the program may be provided by being stored in a computer connected to a network such as the Internet and allowing download to the printer 10 via the network. Further alternatively, the program may be provided or distributed via a network such as the Internet.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

REFERENCE SIGNS LIST

10 Printer
11 Main unit
12 Paper feeding unit
15 Operation panel
20, 20A Post-processing device
37 Disposal tray
68 Sheaf ejecting tray
70 Sheaf processing unit
71 Sheaf processing tray
72 Binding processing unit
75 Remaining quantity sensor
80 Ring binding member
95 Medium loading unit
98*a*, 98*b*, 98*c*, 98*d* Loading position sensor
P Conveyance path

CITATION LIST

Patent Literature

PTL 1: Japanese Patent No. 4872808

The invention claimed is:

1. A printing system in which a series of conveyance paths to convey a recording medium are formed across a printer and a post-processing device, the printing system comprising:

a detection unit that detects that the post-processing device has entered a predetermined state; and a paper feeding control unit that limits the number of recording media fed to the conveyance path based on a first number that is the number of recording media conveyable to the post-processing device after the post-processing device enters the predetermined state, wherein, when the detection unit does not detect that the post-processing device has entered the predetermined state, the paper feeding control unit is configured to determine if the number of recording media in the conveyance path is equal to or less than the first number, cause a recording medium to not be fed in response to determination that the number of recording media in the conveyance path is not equal to or less than the first number, and cause the recording medium to be fed in response to determination that the number of recording media in the conveyance path is equal to or less than the first number, and wherein the paper feeding control unit is configured to increment a feeding count when causing a recording medium to be fed, decrement the feeding count when a recording medium having been subjected to the post processing by the post-processing device is ejected from the post-processing device, and use the feeding count as the number of recording media in the conveyance path.

2. The printing system according to claim 1, wherein the post-processing device comprises a sheaf processing unit that performs processing where the recording media printed by the printer are bound with a binding member for every designated number of recording media and a sheaf of recording media is thus generated and ejected, the detection unit detects, as the predetermined state, that a remaining number of the binding members has become N (where N is a predetermined number) at a timing when the sheaf is ejected, and the paper feeding control unit limits the number of recording media fed to the conveyance path, when it is not detected that the remaining number of the binding members has become N, such that the number of recording media in the conveyance path is equal to or less than the number of recording media processed by the sheaf processing unit with the N+M (where M is the number of the binding members used for generating one of the sheaves) binding members.

3. The printing system according to claim 1, wherein the post-processing device comprises a sheaf processing unit that performs processing where the recording media printed by the printer are bound with a binding member for every designated number of recording media and a sheaf of recording media is thus generated and ejected, the detection unit detects, as the predetermined state, that a remaining number of the binding members has become N (where N is a predetermined number) at a timing when the sheaf is ejected, and the paper feeding control unit limits the number of recording media fed to the conveyance path, when it is not detected that the remaining number of the binding members has become N, such that the number of recording media in the conveyance path is equal to or less than a sum of the number of recording media processed by the sheaf processing unit with the N+M (where M is the number of the binding members used for generating one of the sheaves) binding members and the number of recording media capable of standing by in the sheaf processing unit.

4. The printing system according to claim 1, wherein the post-processing device comprises a medium loading unit that loads the recording media printed by the printer, the detection unit that detects, as the predetermined state, that a loading quantity in the medium loading unit has reached a predetermined quantity, and the paper feeding control unit limits the number of recording media fed to the conveyance path, when it is not detected that the loading quantity in the medium loading unit has reached the predetermined quantity, such that the number of recording media in the conveyance path is equal to or less than the number of recording media loadable in the medium loading unit in excess of the predetermined quantity.

5. The printing system according to claim 4, wherein the number of recording media loadable in the medium loading unit in excess of the predetermined quantity is different according to a thickness of the recording medium.

6. The printing system according to claim 4, wherein the medium loading unit is provided with multiple sensors that detect the loading quantity of recording media at respective multiple levels, and the detection unit detects that the loading quantity in the medium loading unit has reached the predetermined quantity based on a signal from one of the sensors designated in advance from among the multiple sensors.

7. The printing system according to claim 1, wherein the paper feeding control unit that switches, according to a configuration of the printer, whether to limit the number of recording media fed to the conveyance path when it is not detected that the post-processing device has entered the predetermined state.

8. The printing system according to claim 1, further comprising an accepting unit that accepts a user operation selecting one of a first method and a second method as a method of conveying the recording medium, wherein when the first method is selected, the number of recording media fed to the conveyance path is limited by the paper feeding control unit when it is not detected that the post-processing device has entered the predetermined state based on the number of recording media conveyable to the post-processing device after the post-processing device enters the predetermined state, and when the second method is selected, an extra recording medium not conveyable to the post-processing device is ejected to an ejection unit in the printer when it is detected that the post-processing device has entered the predetermined state.

9. A printing system comprising a printer and a post-processing device that binds recording media printed by the printer with a ring binding member for every designated number of recording media and thus generate and eject a sheaf of recording media, wherein a series of conveyance paths to convey the recording medium are formed across the printer and the post-processing device, the printing system comprising:

a detection unit that detects that a remaining number of the ring binding members has become N (where N is a predetermined number) at a timing when the sheaf is ejected; and a paper feeding control unit that limits the number of recording media fed to the conveyance path based on a first number that is the number of recording media to be included in the sheaves generated with the N ring binding members, wherein when the detection unit does not detect that the remaining number of ring binding members has become N, the paper feeding control unit is configured to determine if the number of recording media in the conveyance path is equal to or less than the first number, cause a recording medium to be not fed in response to determination that the number of recording media in the conveyance path is not equal to or less than the first number, and cause the recording medium to be fed in response to determination that the number of recording media in the conveyance path is equal to or less than the first number, wherein when it is detected that the remaining number of the ring binding members has become N, the paper feeding control unit is configured to halt paper feeding of a recording medium to the conveyance path, and wherein the paper feeding control unit is configured to increment a feeding count when causing a recording medium to be fed, decrement the feeding count when a recording medium having been subjected to the post processing by the post-processing device is ejected from the post-processing device, and use the feeding count as the number of recording media in the conveyance path.

* * * * *